US006318235B1

(12) United States Patent
Allart et al.

(10) Patent No.: US 6,318,235 B1
(45) Date of Patent: Nov. 20, 2001

(54) HYDRAULIC MOTOR CYLINDER-CAPACITY SELECTOR FOR AVOIDING JARRING WHEN SWITCHING FROM ONE CYLINDER CAPACITY TO ANOTHER

(75) Inventors: Bernard Allart, Crepy en Valois; Louis Bigo, Compiegne; Jean-Pierre Camilleri, Le Plessis-Brion; Jacques Fontaine, Verberie; Mariele Legai; Louis Martin, both of Compiegne, all of (FR)

(73) Assignee: Poclain Hydraulics Industrie, Verberie (FR)

( * ) Notice: Subject to any disclaimer, the term of this patent is extended or adjusted under 35 U.S.C. 154(b) by 0 days.

(21) Appl. No.: 09/565,090

(22) Filed: May 5, 2000

Related U.S. Application Data

(63) Continuation-in-part of application No. 09/326,476, filed on Jun. 4, 1999.

(51) Int. Cl.[7] ..... F01B 1/06
(52) U.S. Cl. ..... 91/491; 91/519; 60/468
(58) Field of Search ..... 91/519, 491; 60/425, 60/468, 469; 92/12.2

(56) References Cited

U.S. PATENT DOCUMENTS

| | | | | |
|---|---|---|---|---|
| 3,863,447 | * | 2/1975 | Foster et al. | 60/425 |
| 4,807,519 | * | 2/1989 | Wusthof et al. | 91/492 |
| 4,945,816 | * | 8/1990 | Mestieri | 91/473 |
| 5,435,135 | * | 7/1995 | Lallier et al. | 60/425 |

* cited by examiner

*Primary Examiner*—Edward K. Look
*Assistant Examiner*—Igor Kershteyn
(74) *Attorney, Agent, or Firm*—Ladas & Parry

(57) ABSTRACT

A cylinder-capacity selector for a hydraulic motor having at least two active operating cylinder capacities and comprising having at least two main ducts. The selector includes three ports and distribution ducts of the motor to establish selective communication between the main ducts and the cylinders of the motor. When the selector passes between its first and second stable positions, in at least one displacement direction, an intermediate stage exists that is maintained for a lapse of time, during which all three ports are in communication and the section of at least one of the passages between the first and second ports and between the second and third ports of the selector is constricted.

35 Claims, 11 Drawing Sheets

FIG.3A
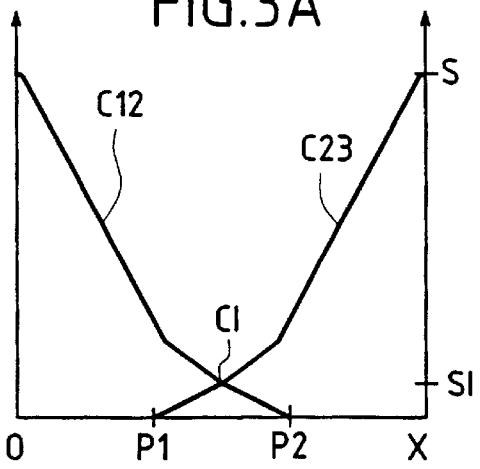
FIG.3B
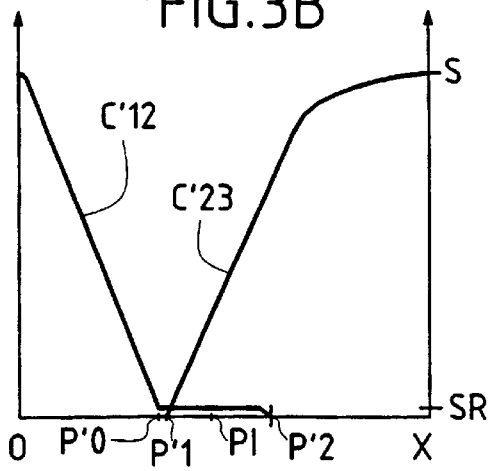
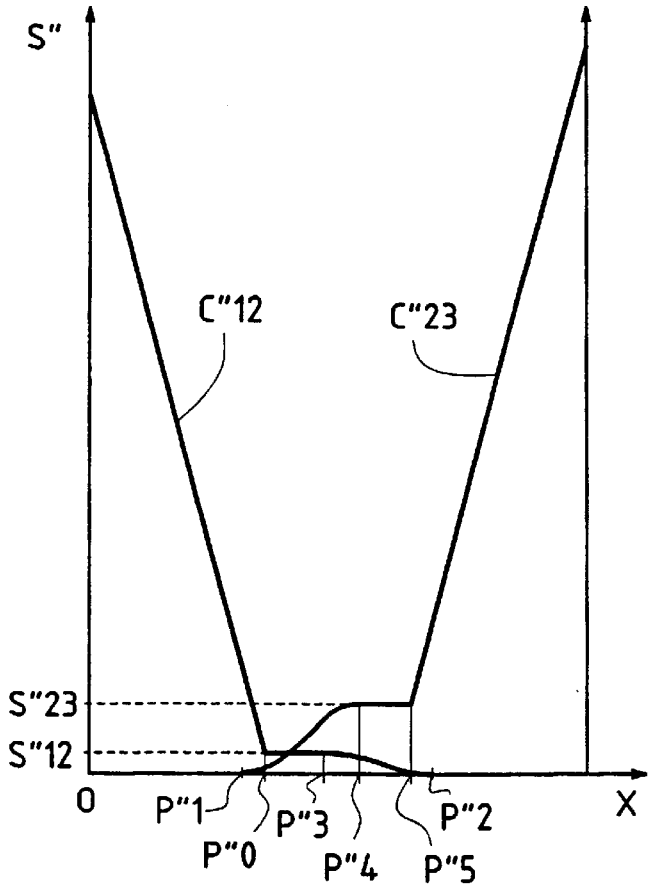
FIG.3C

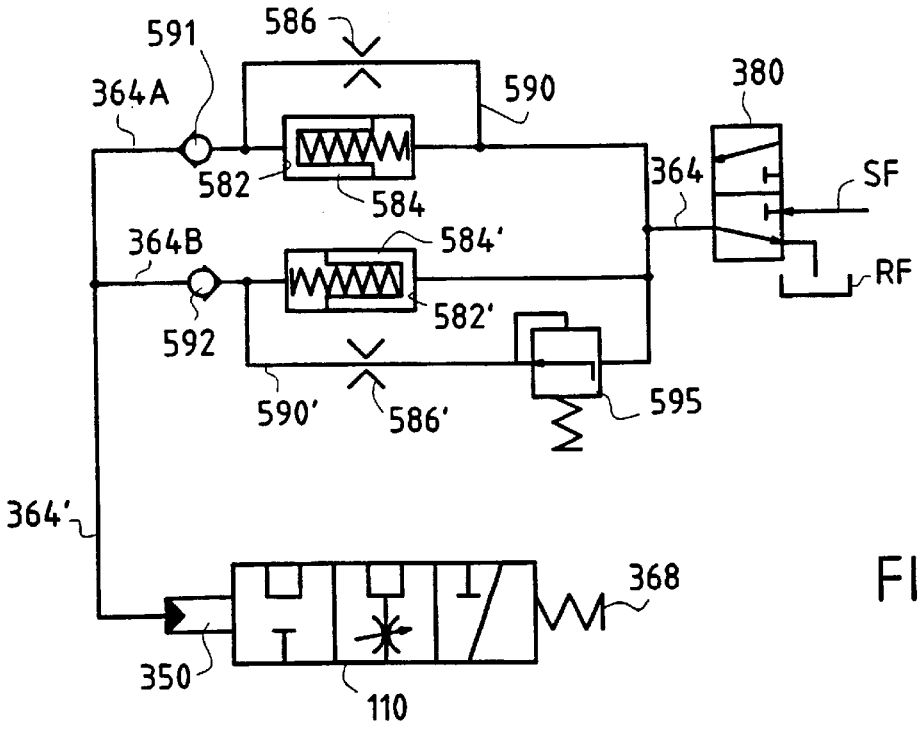
FIG.9
FIG.10
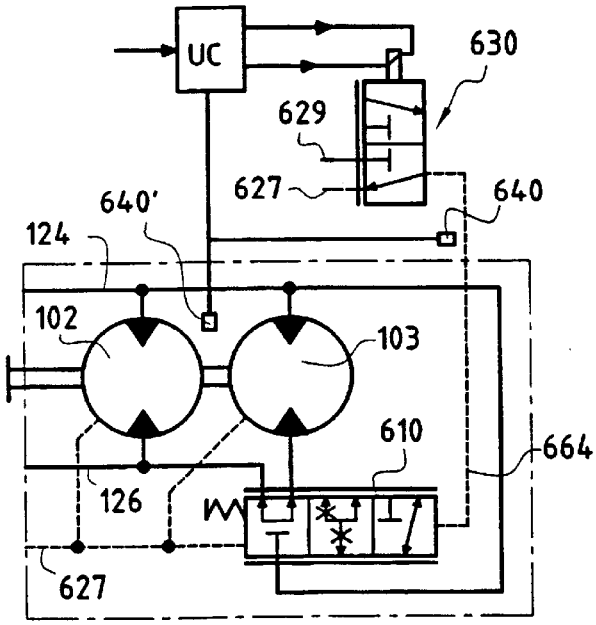
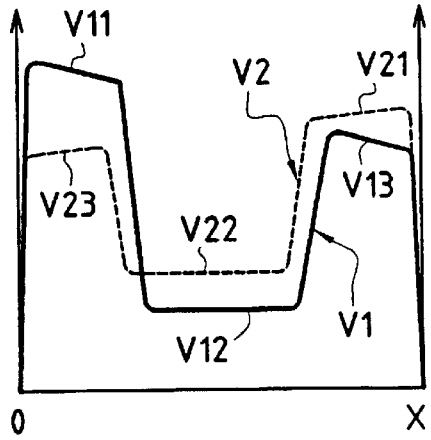
FIG.11

HYDRAULIC MOTOR CYLINDER-CAPACITY SELECTOR FOR AVOIDING JARRING WHEN SWITCHING FROM ONE CYLINDER CAPACITY TO ANOTHER

This application is a continuation-in-part of application Ser. No. 09/326,476, filed Jun. 4,1999.

FIELD OF THE INVENTION

The present invention relates to a selector device for selecting the cylinder capacity of a hydraulic motor having at least two active operating cylinder capacities, the motor comprising at least two main ducts respectively constituting a fluid feed duct and a fluid exhaust duct, the selector device comprising a slide placed in a bore into which at least three communication ports open out, suitable, via distribution ducts of the motor for establishing selective communication between the main ducts and the cylinders of said motor, the third communication port being designed to be connected to one of the main ducts of the motor, the device having selector means which, in a first stable position of the slide, put the second communication port into communication with the third communication port via a passage between the second and third ports, while isolating said second and third ports from the first communication port, and which in a second stable position of the slide, put the second communication port into communication with the first communication port via a passage between the first and second ports while isolating said first and second ports from the third communication port, the selector means being constituted in such a manner that during displacement of the slide between said stable positions, there exists a temporary situation in which both the passage between the first and second ports and the passage between the second and third ports are open simultaneously.

BACKGROUND OF THE INVENTION

The invention applies, for example, to a hydraulic motor having two main ducts, i.e. a feed duct and an exhaust duct.

It also applies to motors having three main ducts, such as, for example, those which are described in FR 2 570 157 and in FR 2 685 263. In those motors, the two cylinder capacities behave like two elementary motors each having a first and a second elementary duct serving as either the feed or the exhaust duct. For the two elementary motors, the first elementary duct can be shared, thus forming a first main duct of the overall motor, while the second elementary ducts are separate, thus forming the second and third main ducts of the overall motor.

The device of the invention can be fitted to a motor having two active operating cylinder capacities. The invention is also applicable to hydraulic motors having a plurality of cylinder-capacity selector slides, such as motors having three distinct non-zero cylinder capacities and two cylinder-capacity selector slides, e.g. of the type described in FR 2 611 816.

For example, the motor comprises three groups of distribution ducts, the distribution ducts of the first group being permanently connected to a first main duct, while the distribution ducts of the third group are permanently connected to the second main duct. The three communication ports which open out into the bore of the selector device are respectively designed to be permanently connected to each of the three groups of distribution ducts. Thus, in the first stable position of the slide, the second and third groups of distribution ducts are connected to each other, while the first group of said ducts is isolated from the others. In the second stable position, it is the first and second groups of distribution ducts that are connected to each other, while the third is isolated therefrom.

For example, in the preferred direction of operation of such a hydraulic motor fitted with the cylindercapacity selector device (the forward direction for a vehicle driven by the motor), the first main duct to which the distribution ducts of the first group are connected is a fluid exhaust duct, while the second main duct to which the distribution ducts of the third group are connected is a fluid feed duct. Thus, at large cylinder capacity, the distribution ducts of the first group serve for fluid exhaust while both the distribution ducts of the third group and the distribution ducts of the second group serve for fluid feed.

In the same direction of operation, at the small cylinder capacity, only the distribution ducts of the third group are used for feeding fluid, while the distribution ducts of the second group are connected to the ducts of the first group and are therefore at discharge pressure, such that the ducts of the second group are not fed with fluid at high pressure and do not contribute to delivering driving torque. Thus, the portion of the cylinder capacity that corresponds to the distribution ducts of the second group is inactive.

In the other direction of operation of the motor, and at small cylinder capacity, only the distribution ducts of the third group are connected to the discharge, while the distribution ducts of the first and second groups are connected to the feed. Thus, for example in a hydraulic motor having pistons, the pistons which are connected successively to a duct of the second group and to a duct of the first group tend to remain, between those two successive connections, in their extended position and they no longer contribute to providing driving torque. Nevertheless, these pistons tend to develop a certain amount of resistance to driving torque.

When the selector changes between its two stable positions, the temporary situation in which the passages between the first and second ports and between the second and third ports are simultaneously open serves to prevent the motor jamming during displacement of the selector slide. In this temporary position, all of the distribution ducts are in communication with one another and the motor freewheels.

At constant flow rate from the pump feeding the main feed duct, it is known that in the large cylindercapacity position, the motor develops high torque at relatively slow speed while at small cylinder capacity, the torque developed is lower and the speed is higher.

In the preferred operating direction of a motor, when the selector slide is moved from its second stable position for small cylinder capacity towards its first stable position for large cylinder capacity, there is a changeover between a situation in which the fluid flow delivered by the pump passes from feeding only the distribution ducts of the third group to a situation in which the same fluid flow needs to feed the distribution ducts of both the second and the third groups. Consequently, the fluid pressure in the main feed duct tends to drop, and it is maintained at a value that prevents cavitation phenomena by fluid being delivered from a booster pump in addition to the fluid being delivered by the main pump. This booster delivery of fluid is associated with the fact that the speed of the motor continues to be fast under the effect of the inertia of the load driven by the motor.

At that moment, the fluid flow exhausted by the main exhaust duct suddenly becomes greater than the fluid flow it was previously exhausting since it is now connected not only to the fluid flow delivered by the main pump, but also to the fluid flow delivered by the booster pump.

The pressure in the exhaust duct therefore increases suddenly and the load driven by the motor is braked suddenly. This braking is sufficiently abrupt to generate quite violent jarring.

When the motor is used to drive a vehicle, and when the vehicle has no special equipment, the driver of the vehicle can forestall this jarring only by causing the main pump to deliver a momentary increase in fluid flow rate while simultaneously causing a changeover to take place from small cylinder capacity to large cylinder capacity, assuming that the feed circuit constitutes a closed circuit.

There also exist sophisticated systems for avoiding this jarring effect, that rely on servo-controlling the pressure delivered by the pump and the speed of the motor. Such systems suffer from the drawback of being expensive.

Conversely, when the selector slide is moved from its first stable position for large cylinder capacity to its second stable position for small cylinder capacity, quite a sudden acceleration effect occurs. Although the jarring involved is smaller than in the first case since on changing over to small cylinder capacity, driving torque is also reduced, it is perceived as a fault by the driver of the vehicle.

The invention also applies to a motor having two distinct operating cylinder capacities, and comprising four groups of distribution ducts. In the large cylinder capacity, the groups are connected together in pairs so as to be put into communication respectively with a main feed duct and a main exhaust duct. In the small cylinder capacity, one group is connected to the feed duct, and another group to the exhaust duct, and the two groups corresponding to the deactivated cylinder capacity are connected to each other, e.g. by being put into communication with an auxiliary duct such as a booster duct.

In this case also, the sudden changeover from one cylinder capacity to another causes jarring which can be disagreeable, or even dangerous.

The motor can also have a larger number of cylinder capacities, e.g. three distinct cylinder capacities, i.e. a large, a medium, or a small cylinder capacity. In this case also, it is advisable to avoid sudden jarring when changing over from one cylinder capacity to another.

OBJECTS AND SUMMARY OF THE INVENTION

The present invention seeks to propose a simple system for reducing the jarring effect when changing over from one cylinder capacity to another.

This object is achieved by the fact that the cylinder-capacity selector device of the invention comprises means, effective in at least one displacement direction of the slide between its first and second stable positions, to maintain said temporary situation for a time lapse in an intermediate stage during which the section of at least one of the passages constituted by the passage between the first and second ports and by the passage between the second and third ports is constricted.

During the intermediate stage, the sections of the passages between the first and second ports and between the second and third ports are preferably different.

The time lapse during which the intermediate stage is maintained is determined as a function of the characteristics of the motor and of the objects (vehicle . . . ) that it is designed to drive, so as to be sufficient to ensure that, by maintaining the intermediate stage, a sudden variation in the flow of fluid in the main ducts is prevented. Nevertheless, the temporary situation which is maintained does not correspond to a short-circuit situation since, because of the presence of a constriction on the section of at least one of the passages between the first and second ports and between the second and third ports, the distribution ducts do not communicate freely between one another.

For example, it is possible to choose to maintain the temporary situation during the changeover from the small cylinder capacity to the large cylinder capacity.

For a motor, driving one of the wheels of a 5-ton vehicle traveling at a speed of about 10 km/h when the cylinder capacity is changed over and having torques in small and in large cylinder capacity that are respectively 1500 N.m and 3000 N.m, the time lapse during which the temporary situation is maintained can be about two-tenths of a second to five-tenths of a second, or even 1 second. The same applies for a motor driving one of the displacement members of a 24-ton vehicle (12 tons per motor) at a speed of about 3 km/h when the cylinder capacity is changed over and having torques in small and in large cylinder capacity that are respectively 20000 N.m and 40000 N.m. To maintain the temporary situation, the displacement of the slide can be slowed down or braked, or even substantially stopped during the necessary lapse of time.

For example, for a motor having three distribution groups permanently connected to each of the three communication ports, and for which the first and second stable positions of the slide are respectively the large cylinder-capacity and the small cylinder-capacity positions, it is possible to choose to maintain the intermediate stage during the changeover from the small cylinder capacity to the large cylinder capacity, so that in the intermediate stage, the passage between the first and second ports forms a constriction, while the passage between the second and third ports is substantially free or at least forms a smaller constriction, i.e. allows a greater flow of fluid to pass therethrough than passes through the other passage.

In this case, considering the motor operating in its preferred direction, in which the distribution ducts of the third group are connected to the fluid feed, putting the second and third ports into communication increases the cylinder capacity that is to be fed, so pressure tends to drop in the feed duct, with this drop possibly being compensated by boosting. Simultaneously, the partial communication established between the first and second ports, via the constriction, limits the extent to which pressure can increase in the discharge duct. The constriction gives rise to a loss of head. This makes it possible to control the appearance of back pressure in this discharge duct and consequently to control the braking of the motor.

Since displacement of the slide is slowed down in the intermediate stage, the constricted communication established between the first and second ports continues for the length of time required for the kinetic energy of the vehicle or the load driven by the motor to be consumed by the braking effect of said motor.

When the motor is operating in the opposite direction, the first and third groups of distribution ducts are respectively connected to the fluid feed and to the fluid exhaust, so changing over from small cylinder capacity to large cylinder capacity causes all of the ducts of the second and third groups of distribution ducts to be connected to the exhaust, so that the flow rate in the main exhaust duct increases. Since this flow rate is greater than that entering the pump, it must escape via a pressure release valve. The pressure generated in this way brakes the motor.

In the intermediate position of the slide, a portion of the additional flow can pass from the second group of distribution ducts to the first with back pressure comparable to that produced in the preferred direction of operation as described above.

The constriction through which the first and second ports communicate in the intermediate position thus has a similar effect in both directions of operation of the motor.

As in the above-mentioned example, it is possible to choose to implement the invention so as to limit jarring in only one of the displacement directions of the slide, e.g. during changeover from the small cylinder capacity to the large cylinder capacity.

It is also possible to choose to limit jarring in both displacement directions so that an intermediate stage as mentioned above exists in both of said directions. As explained below, it is thus possible to opt for the section of at least one of the passages between the first and second ports and between the second and third ports to be small during the intermediate stage, while the section of the other passage is capable of passing a fluid flow that is substantially free.

It is also possible to opt for the sections of both passages to be constricted or calibrated, while also being different.

Thus, in a first variant, during the intermediate stage, the section of one of the passages between the first and second ports and between the second and third ports is constricted, while the fluid flow in the other of said passages is substantially free.

In a second variant, during the intermediate stage, the sections of each of the passages between the first and second ports and between the second and third ports are constricted.

The device of the invention advantageously includes means for controlling the displacement of the slide in the direction that includes the intermediate stage, said means being capable of implementing a fast first displacement step of the slide from its initial position to a position corresponding to the start of the intermediate stage, and a braking displacement step during which said intermediate stage takes place.

By means of these dispositions, the total time required for changing over from one cylinder capacity to the other is not substantially increased since the displacement of the slide is slowed down only during the intermediate stage, whereas the other displacement steps are performed quickly.

For example, the displacement speed of the slide during the intermediate stage is at most equal to one-third of its displacement speed during the fast first displacement step.

For example, the slowing down is such that the duration of the intermediate stage is not less than two-thirds the total duration of the displacement of the slide between the two extreme positions.

The control means are advantageously also capable of implementing a fast second displacement step of the slide after the intermediate stage.

The control means for controlling the displacement of the slide can, for example, be purely hydraulic, or even purely electronic. They can even be means combining both hydraulic means and electronic means. When they are present, the electronic means advantageously comprise a servomechanism.

The section which is constricted during the intermediate stage advantageously remains substantially constant (or at least it varies very smoothly) during at least part of the duration of said intermediate stage.

During this stage, there are thus no sudden changes in the section of the passage concerned, such that the pressure in the ducts connected thereto does not vary suddenly.

It is possible to opt for said section to remain substantially constant during a major portion of the duration of the intermediate stage, measured in terms either of slide displacement travel and/or displacement duration. For example, it can remain substantially constant during a time lapse that is not less than half of the total duration of the intermediate stage and preferably not less than two-thirds of said duration.

It is also possible to choose to vary the section of the passage by adapting its shape (an oblong shape having a progressively-varying section or even a choice of several constriction holes that are successively uncovered or covered).

In an advantageous disposition, one of the passages between the first and second ports and between the second and third ports having a constricted section during the intermediate stage has a first and second portion, the first portion enabling fluid to flow substantially freely, being open in the initial position of the slide before a displacement comprising the intermediate stage, and being closed in the intermediate stage, the second portion being fitted with a constriction which defines the opening of said constricted passage during the intermediate stage.

The first portion of the passage concerned presents a relatively large section which provides free communication between the distribution ducts which are connected thereto. The fact that the other passage opens only when said first portion is closed makes it possible to avoid having substantially free communication between the distribution ducts, so the motor does not freewheel during displacement of the selector slide. The constriction which prevents the short-circuit is implemented by the second portion of said passage concerned, with this portion remaining open during the intermediate stage even while the other passage is also open.

In an advantageous embodiment, the control means for controlling displacement of the slide comprise a first control chamber formed in the bore at one end of the slide, and a second control chamber formed in a cavity at said end of the slide and separated from the first chamber by a control piston disposed in said cavity, the first control chamber being suitable for being connected to first pilot means to enable the assembly constituted by the slide and the control piston to be displaced during a fast first displacement step, at the end of which the control piston is in an extreme position, and the second control chamber being suitable for being connected to second pilot means to enable the slide to be displaced relative to the control piston in a slow second displacement step.

These dispositions constitute a simple and compact manner of implementing the slide control means.

The control means for controlling the displacement of the slide advantageously comprise a third control chamber which serves to control the displacements of the slide in the other direction.

In another advantageous embodiment, the control means for controlling displacement of the slide comprise a control chamber connected to a pilot duct, means for measuring a volume of pilot fluid and designed to enable a determined volume of fluid to flow substantially freely in the pilot duct in at least a first flow direction causing the slide to be displaced in a first direction including a first intermediate stage, and means for allowing an additional volume of fluid to flow in the pilot duct in said first flow direction only via a first constriction.

The means for measuring fluid volume, like the first constriction, can be disposed outside the bore of the cylinder-capacity selector device, or indeed outside the motor.

Advantageously, the pilot duct has a measuring chamber in which there is disposed a measuring piston suitable, under the effect of a pilot fluid, for being displaced between a first position and a second position to cause a volume of fluid corresponding to the stroke of said piston to flow in a segment of pilot duct extending between the measuring chamber and the control chamber; when the measuring piston occupies its second pilot position, an additional volume of fluid can flow in said segment, at least in the first flow direction, only via the first constriction.

The measuring piston constitutes a simple device for measuring out the above-mentioned volume of pilot fluid.

BRIEF DESCRIPTION OF THE DRAWINGS

The invention will be well understood and its advantages will appear more clearly on reading the following detailed description of embodiments described as examples. The description refers to the accompanying drawings, in which:

FIGS. 3A, 3B, and 3C are graphs with curves illustrating variation in passage section both between the first and second ports and between the second and third ports as a function of slide displacement, FIG. 3A relating to a conventional cylinder-capacity selector device, while FIGS. 3B and 3C relate to the devices of the invention;

FIGS. 6 to 10 show variant embodiments relating in particular to the means for controlling the selector slide of the device of the invention, FIGS. 6 to 9 showing hydraulic control, and FIG. 10 showing electronic control combined with electro-hydraulic control;

FIG. 11 is a graph with curves illustrating variations in displacement speed of the slide as a function of its stroke, in each of the two displacement directions;

MORE DETAILED DESCRIPTION

Figure 1:
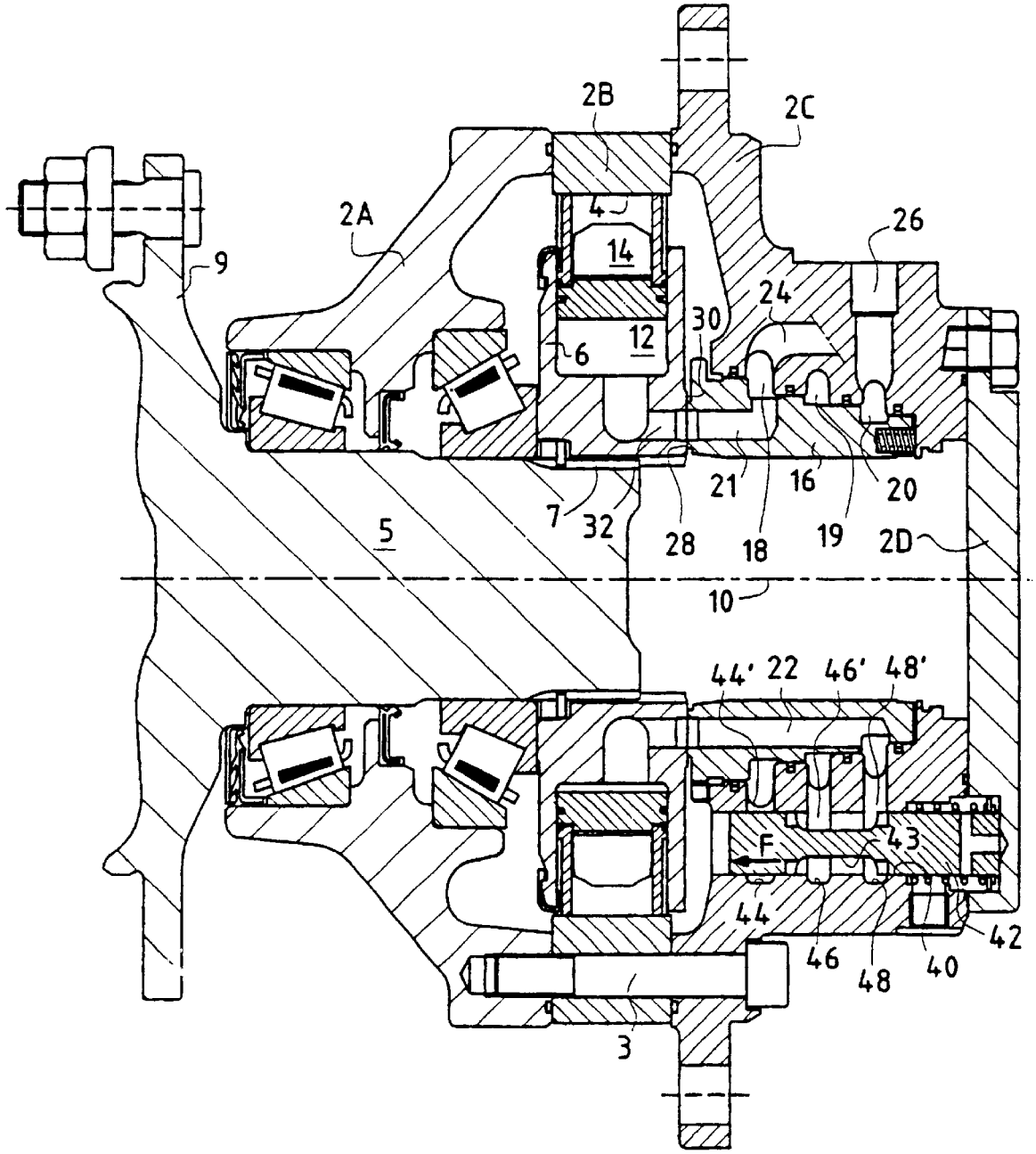
FIG. 1 is an axial section view of a hydraulic motor having radial pistons and fitted with a conventional cylinder-capacity selector device.

FIG. 1 shows a hydraulic motor comprising a fixed case in three parts 2A, 2B, and 2C that are assembled together by screws 3. The part 2C of the case is closed axially by a radial plate 2D that is also fixed by means of screws. An undulating reaction cam 4 is formed on the part 2B of the case.

The motor has a cylinder block 6 which is mounted to rotate about an axis of rotation 10 relative to the cam 4, and which has a plurality of radial cylinders 12 suitable for being fed with fluid under pressure and within which radial pistons 14 are slidably received.

The cylinder block 6 rotates a shaft 5 which co-operates therewith via fluting 7. The end of the shaft remote from the cover 2D of the case has an outlet flange 9.

The motor also has an internal fluid distributor 16 which is constrained in rotation with the case about the axis 10. The distributor 16 and the axially inner face of the part 2C of the case are formed with distribution grooves, respectively a first groove 18, a second groove 19, and a third groove 20. The distribution ducts of the distributor 16 are organized as a first group of ducts which, like the duct 21, are all connected to the groove 18, a second group of ducts (not shown) which are connected to the groove 19, and a third group of ducts which, like the duct 22, are connected to the groove 20. The first groove 18 is permanently connected to a first main duct 24 so all of the distribution ducts in the first group are thus permanently connected thereto. The third groove 20 is permanently connected to a second main duct 26 so all of the distribution ducts in the third group are permanently connected thereto.

Depending on the selected direction of rotation of the motor, the main ducts 24 and 26 act respectively as a fluid feed duct and as a fluid exhaust duct, or vice versa.

In conventional manner, the distribution ducts open out in a distribution face 28 of the internal fluid distributor, pressing against a communication face 30 of the cylinder block. Each cylinder 12 has a cylinder duct 32 which opens out into said communication face 30 in such a manner that during rotation of the cylinder block relative to the cam, the cylinder duct communicates in alternation with the distribution ducts of the various groups.

The cylinder-capacity selector device for the motor of FIG. 1 comprises a bore 40 which extends axially in part 2C of the case and in which there is placed an axially-movable selector slide 42. The bore 40 has three communication ports, namely a first communication port 44 permanently connected to the groove 18, and thus to the distribution ducts 21 of the first group, a second communication port 46 permanently connected to the groove 19 and thus to the distribution ducts of the second group, and a third communication port 48 permanently connected to the distribution ducts 22 of the third group via the groove 20.

The communication ports are implemented in the form of grooves formed in the bore 40 and respectively connected to the grooves 18, 19, and 20 via respective link ducts 44', 46', and 48'. The slide 42 is movable between two extreme positions inside the bore 40. It is shown in its first position in which it puts the grooves 46 and 48 into communication via a groove 43 formed in its outer periphery, while it leaves the groove 44 isolated. In this situation, the distribution ducts of the second and third groups are connected to the main duct 26, e.g. a feed duct, while the distribution ducts of the first group 18 are connected to the main duct 24, e.g. an exhaust duct.

The number of distribution ducts in the first group 18 is equal to the sum of the numbers of distribution ducts in the second and third groups, and the distribution ducts of the first group are interposed between those of the second and third groups. Consequently, in this situation, the cylinder ducts are connected in alternation to the feed and to the exhaust during relative rotation between the cylinder block and the cam. The motor can thus operate at its maximum or large cylinder capacity.

The slide can occupy another position, in which it is displaced in the direction of arrow F and in which it puts the grooves 44 and 46 into communication while it isolates these grooves from the groove 48. Consequently, in this situation, the distribution ducts of the third group are the only ducts to remain connected to the main duct 26, while the distribution ducts of the first and second groups are all connected to the main duct 24. The lobes of the cam which correspond to the distribution ducts 20 are thus active since the pistons which pass in register with these cam lobes during relative rotation between the cylinder block and the cam are connected in alternation to a distribution duct of the third group and to a distribution duct of the first group, which are themselves respectively connected to the two main ducts. However, the cam lobes which correspond to the distribution ducts of the second group are inactive since the cylinders of the pistons which pass in register with these cam lobes are connected in succession to a duct of the second group and to a duct of the first group, both of which are connected to the same main duct.

FIG. 1 shows a conventional cylinder-capacity selector device, and it will be understood that the geometry of the groove 43 makes it possible, when the slide is in its middle position between its first and second extreme positions, momentarily to put all three communication ports 44, 46, and 48 into communication with one another. This middle position corresponds to an intermediate situation in which all three communication ports 44, 46, and 48 are temporarily in communication with one another, so that all of the distribution ducts are interconnected and the motor freewheels.

Figure 2:
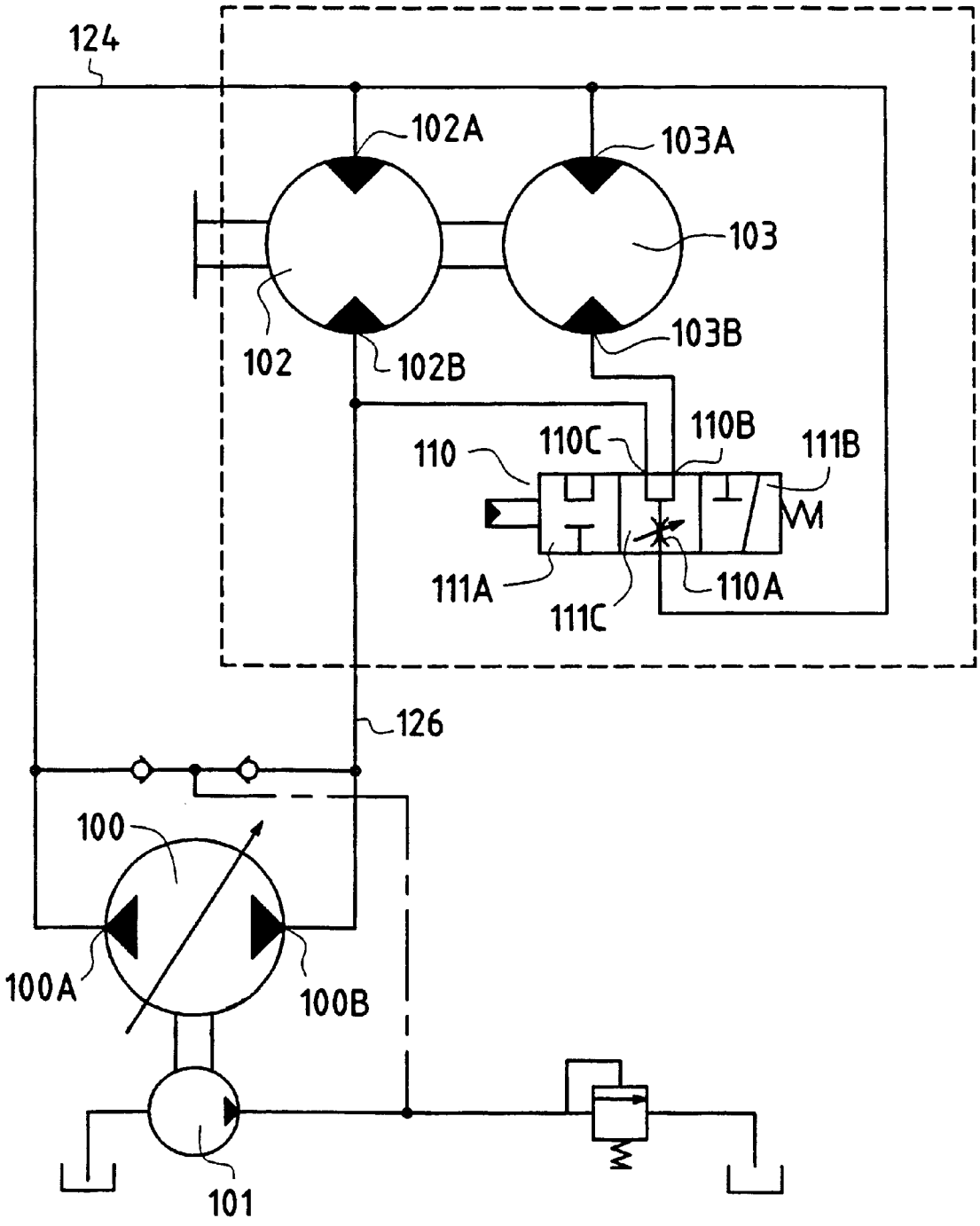
FIG. 2 is a hydraulic circuit diagram including a hydraulic motor with two cylinder capacities and fitted with a cylinder-capacity selector device of the invention, for a closed circuit.

FIG. 2 is a schematic view for the selector device of the invention. As shown, this circuit is simplified and has only those elements which are required to make the figure understandable, certain additional elements being omitted, for example certain conventional control means and safety means.

The circuit is a closed circuit having a main pump 100 which is associated with a booster pump 101. The two operating cylinder capacities of the motor fed by the pump 100 are respectively designated by references 102 and 103. One of the outlets of the main pump is connected to a first main duct 124 which has the distribution ducts of a first group of distribution ducts of the motor connected thereto.

Each of the two cylinder capacities of the motor behaves like an elementary motor, so each of them is represented diagrammatically as such in FIG. 2. Thus, the elementary motor 102 has two main orifices, respectively designated by references 102A and 102B, while the elementary motor 103 has two main orifices respectively 103A and 103B.

The orifices 102A and 103A are permanently connected to each other and to the first above-mentioned main duct 124 which is itself connected to a first orifice 100A of the pump 100. Similarly, the orifice 102B of the motor 102 is permanently connected to a second main duct 126 itself connected to the second orifice 100B of the pump.

The circuit of FIG. 2 has a three-port selector 110, comprising a first port 110A permanently connected to the first main duct 124, a second port 110B permanently connected to the orifice 103B of the motor 103, and a third port 110C permanently connected to the orifice 102B of the motor 102.

The motor in the diagram of FIG. 2 differs from that of FIG. 1 in the configuration of the cylindercapacity selector device. Otherwise, it will be understood that the distribution ducts of the motor of FIG. 2 which are connected to the orifices 102A and 103A of the elementary motors 102 and 103 correspond to the distribution ducts of the first group of the motor shown in FIG. 1, while the distribution ducts of elementary motor 102 which are connected to the orifice 102B correspond to those of the third group, and the distribution ducts of elementary motor 103 which are connected to orifice 103B correspond to those of the second group. The three ports 110A, 110B, and 110C of the selector 110 of FIG. 2 correspond respectively to the first, the second, and the third ports 44, 46, and 48 of the selector of FIG. 1.

The selector 110 has two stable extreme positions and an unstable intermediate position. In the first stable position 110A, the second and third ports 110B and 110C are interconnected and are connected to the duct 126, while the port 110A is isolated from the first and second ports 110B and 110C. This is the large cylindercapacity position. In the second stable position 110B, the first and second ports 110A and 110B are interconnected and connected to the duct 124, while the port 110C is isolated from said first and second ports, which corresponds to the small cylinder capacity. The diagram of FIG. 2 shows the selector in its unstable intermediate position 110C, in which the ports 110B and 110C communicate with each other in substantially free manner, and communicate with the first port 110A via a constriction.

The circuit of FIG. 2 is a closed circuit in which, when there is an increase in pressure in the discharge duct associated with changing over from small cylinder capacity to large cylinder capacity, it is possible to transmit a portion of the braking energy to the pump.

The motor shown in FIG. 2 can also be fed via an open circuit (not shown) having the same operating conditions providing that the discharge from the motor includes a control device for controlling the flow rate.

FIG. 3A applies to a conventional selector and shows how the flow section between the first and second communication ports and how the flow section between the second and third communication ports vary (respectively curve C12 and curve C23) during displacement of the selector from its small cylinder-capacity position to its large cylinder-capacity position.

When the selector is in position 0, the flow section between the first and second ports is at a maximum, while the flow section between the second and third ports is zero.

During displacement of the slide towards its large cylinder-capacity position X, the flow section between the first and second ports decreases continuously until the slide reaches a position Pi, beyond which the curve C12 bends slightly and beyond which the flow section between the second and third ports begins to open up. The flow section between the first and second ports continues to decrease until the selector reaches a position P2 in which this flow section becomes zero.

Simultaneously, the flow section between the second and third ports increases. From point P2, curve 23 rises more steeply. It can thus be seen that between points Pi and P2, the flow sections between the first and second ports and between the second and third ports are simultaneously non-zero, such that all three communication ports are interconnected. When no particular precaution is taken, the motor then freewheels, as mentioned above.

The curves C12 and C23 are generally symmetrical about their point of intersection CI. For example, the maximum values S of the flow sections between the first and second ports and between the second and third ports are about 200 $mm^2$. The flow section SI corresponding to point CI is about 20 $mm^2$, for example. By way of example, the displacement X corresponds to a stroke of 12 mm for the slide 42 of the selector of FIG. 1.

FIG. 3B shows curves analogous to those of FIG. 3A, but for a selector device of the invention, for a variant in which only one of the passages (in this case the passage between the first and second ports) is constricted during the intermediate stage, while the section of the other passage is substantially free. Thus, curves C'12 and C'23 show respectively how the flow section between the ports 110A and 10B and how the flow section between the ports 110B and 110C vary during displacement of the selector from its small cylinder-capacity position 11B (position 0 in FIG. 3B) to its large cylinder-capacity position 111A (position A).

During this displacement, the flow section between the ports 110A and 110B varies initially between a maximum section S and a constriction section SR with this variation being a substantially linear function of the displacement of the selector up to a point P'0. Thereafter, during continued displacement of the selector, the flow section between the ports 110A and 110B remains substantially constant and is fixed to the value SR until the section becomes zero at a point P'2.

Through the first stage of selector displacement, the section between the second and third ports 110B and 110C remains zero, and it begins to open only at a point P'1 situated beyond the point P'0, i.e. the passage between the ports 110B and 110C opens only once the flow section between the ports 110A and 110B is already at the value SR. Starting from this point P'1, the flow section between the ports 110B and 110C increases rapidly, firstly following a stage in which increase is substantially linear as a function of displacement, and then following a curve that is less steep. In this way, at the point P'2 at which the flow section between the ports 110A and 110B becomes zero, the flow section between the ports 110B and 110C has already almost reached its maximum value S.

For example, the section S is about 200 $mm^2$, while the section SR is only about 3 $mm^2$. The points P'1 and P'2 correspond respectively to the first and second intermediate positions of the selector slide during the intermediate stage. As mentioned above, the flow section between the first and second ports remains substantially constant (SR) throughout the major portion of the displacement stroke of the slide between its first and second intermediate positions, except immediately before the point P'2.

FIG. 3C shows curves analogous to those of FIG. 3B, for another selector device of the invention, for a variant in which the passage between the first and second ports and the passage between the second and third ports are both constricted during the intermediate stage, but have different values.

Curves C"12 and C"23 show respectively how the section of the passage between the first and second ports and how the section of the passage between the second and third ports vary during displacement of the slide. For example, position 0 of the slide corresponds to the small cylinder capacity, while its position X corresponds to the large cylinder capacity.

During displacement of the slide from its position 0 to its position X, the section of the passage between the first and second ports varies, rapidly at first, until it reaches a section S"12 for a position P"0 of the slide. When the slide continues to move towards its position X from the position P'0, the section varies little, and it remains, for example, substantially constant between the position P"0 and a position P"3 before decreasing further to become zero at a position P'2 of the slide.

During the same displacement, the section of the passage between the second and third ports remains zero as long as the section of the passage between the first and second ports remains relatively large, i.e. over at least a major portion of the stroke of the displacement of the slide between its position 0 and the position P"0. The section of the passage between the second and third ports begins to open for a position P"1 of the slide which is adjacent to its position P"0.

When the slide moves beyond the position P"1, the section of the passage between the second and third ports increases until a value of section S"23 is reached for a position P"4 of the slide. It begins to increase greatly only from a position P"5 of the slide, for which the section of the passage between the first and second ports is practically zero, i.e. the position P"5 is adjacent to the position P"2, slightly before or slightly after. In the example shown, between the positions P"4 and P"5, the section of the passage between the second and third ports remains substantially constant, at the value S"23.

For example, the maximum sections S" of each of the two passages are about 600 $mm^2$, while the sections S"23 and S"12 are respectively about 50 $mm^2$ and 15 $mm^2$.

During displacement of the slide between its position 0 and its position X, an intermediate stage is maintained between the positions P"0 and P"5. It can intervene in a single displacement direction or in both directions, depending on whether the control means for controlling the displacement of the slide slow it down between the positions P"0 and P"5 in one direction or in both directions.

The intermediate stage(s) include ranges over which the constricted sections of the passages remain substantially constant at the respective values S"12 and S"23.

The sections S"12 and S"23 are adapted to the flow rates passing via the sections in the various operating stages, either for the changeover from small cylinder capacity to large cylinder capacity, or for the changeover from large cylinder capacity to small cylinder capacity. The head losses thus generated in these conditions correspond to decelerations or accelerations that are adjusted for driving safety and comfort. For example, in the case shown, the fluid flow rate in the section S"12 during the changeover from the small cylinder capacity to the large cylinder capacity for a given speed of the vehicle is less than the flow rate passing through the section S"23 during the changeover from the large cylinder capacity to the small cylinder capacity, at the same speed.

Figure 4A:
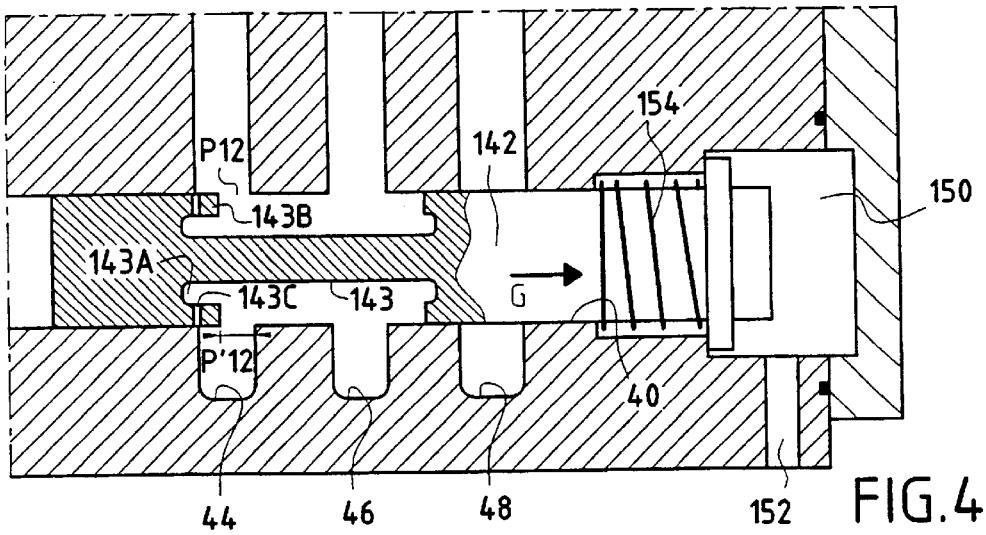
FIGS. 4A, 4B, and 4C show three positions of the selector slide in a device of the invention.
Figure 4B:
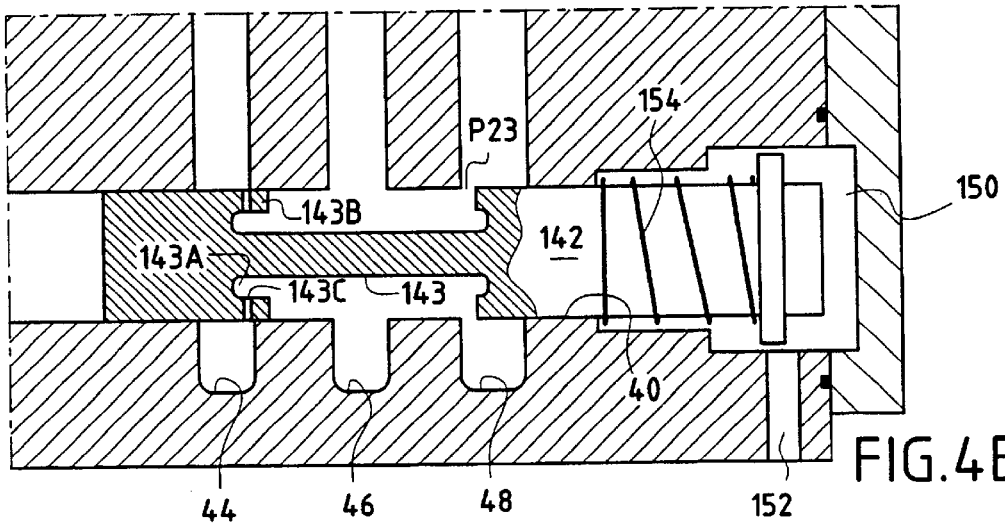
Figure 4C:
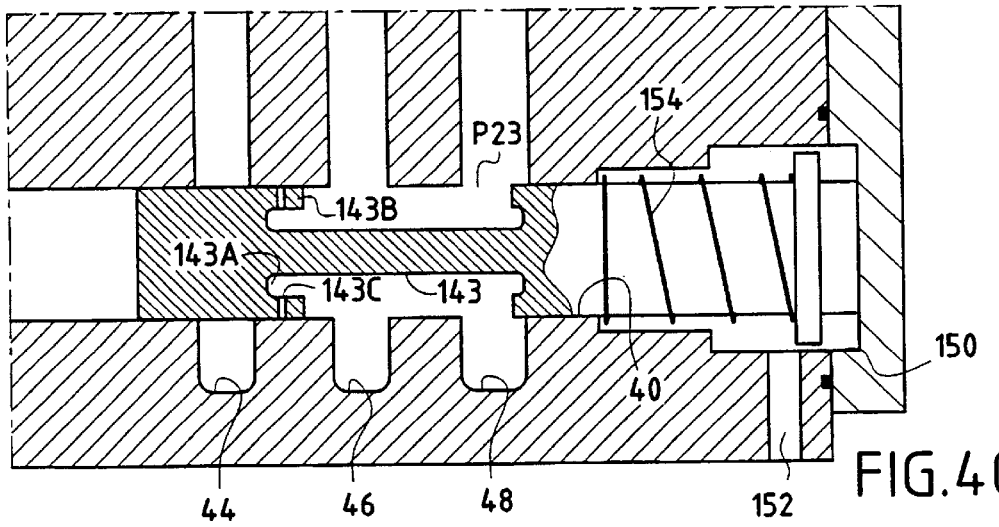

FIGS. 4A to 4C show the cylinder-capacity selector device of a variant of the invention in which the bore 40 is substantially identical to that of the selector device of FIG. 1, while the slide 142 is different from the slide 42. FIG. 4A shows the slide in a stable position, e.g. a small cylinder-capacity position, and it can be seen that the first and second communication ports 44 and 46 are interconnected while the port 48 is isolated therefrom. Conversely, FIG. 4C shows the position of the slide 142 that corresponds to the other stable position, e.g. a large cylinder-capacity position.

In FIG. 4A, the groove 143 of the slide is in register with the two grooves 44 and 46, while in the position of FIG. 4C, the same groove 143 is in register with the two grooves 46 and 48. In the situations of FIGS. 4A and 4C, the intercommunication implemented by the selector means constituted by the groove 143 and the wall of the bore 40 is substantially unimpeded and free of constriction. In FIG. 4A, the first and second communication ports communicate freely with each other via a passage P12, while in FIG. 4C, the second and third ports communicate freely via a passage P23.

The end 143A of the groove 143 situated beside the first communication port 44 has a special shape. This end is formed beneath an annular rim 143B of the cylindrical wall of the slide 142, which rim has small diameter holes 143C passing therethrough to form constrictions.

When the slide 142 is moved from its position as shown in FIG. 4A towards its position as shown in FIG. 4C in the direction of arrow G, the flow section P12 decreases and then becomes zero as shown by curve C'12 in FIG. 3B, while the flow section P23 becomes non-zero and increases as shown by curve C'23.

FIG. 4B shows the intermediate situation corresponding generally to the position PI in FIG. 3B, where the passage P23 is open and allows fluid to flow between the grooves 46 and 48 at a relatively high rate with relatively low head loss, while the passage P12 is reduced to the constrictions 143C. These constrictions thus give rise to a loss of head between the port 44 and the ports 46 & 48, and this makes it possible, as mentioned above, to brake the motor "gently" when changing from its high speed small cylinder-capacity to its low speed large cylinder-capacity.

With reference to FIG. 4A, it can be seen that the passage P12 between the first and second ports has a first portion P'12 which, in this figure, is defined between the end of the rim 143B of the groove 143 and the face of the groove 44 which is situated axially in register therewith. The passage P12 also has a second portion constituted by the holes 143C through the rim 143B and forming the constrictions. In the second position of the slide shown in FIG. 4A, the first portion P'12 allows substantially free communication between the ports 44 and 46. When the slide moves towards its first position, this first portion P'12 closes before the passage P23 opens between the second and third ports. Once that happens, only the holes 143C allow constricted communication between the first and second ports, with this taking place during the intermediate stage.

If the other end of the groove 143 included constrictions, analogous to the holes 143C but of different total section, then the situation during displacement of the slide would be as in FIG. 3C.

In FIGS. 4A to 4C, the means for controlling displacement of the slide 142 are shown diagrammatically. These means comprise a control chamber 150 formed at one end of the slide and suitable for being fed with fluid via a duct 152 to place the slide in its second position as shown in FIG. 4A and against the reaction forces exerted by a spring 154 or the like. When the chamber 150 is emptied by the duct 152, the spring 154 returns the slide resiliently into its first position as shown in FIG. 4C.

It is possible to vary the speed at which the selector slide moves by varying the pressure in the control chamber 150.

Figure 5A:
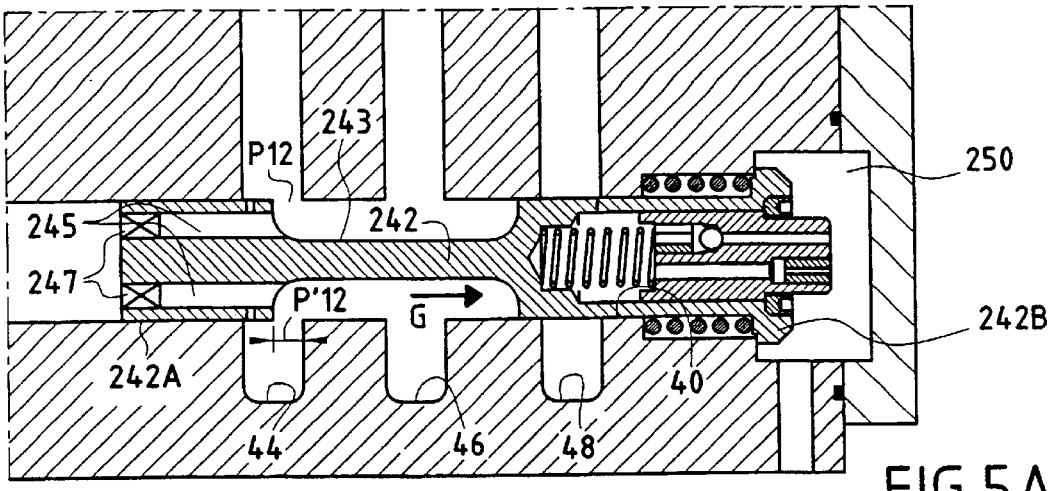
FIGS. 5A, 5B, and 5C are views analogous to FIGS. 4A, 4B, and 4C, relating to an advantageous variant, with FIG. 5D being an enlarged view of detail V in FIG. 5B.
Figure 5B:
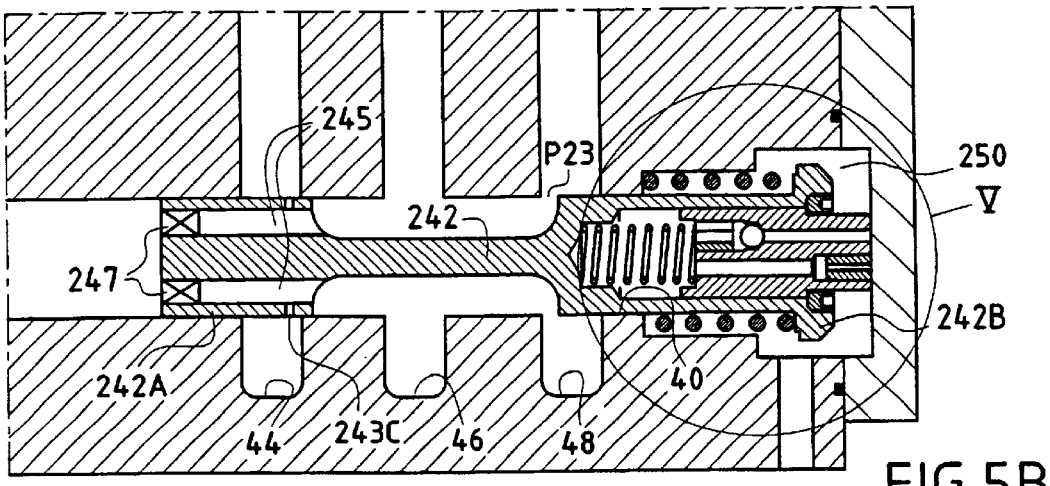
Figure 5C:
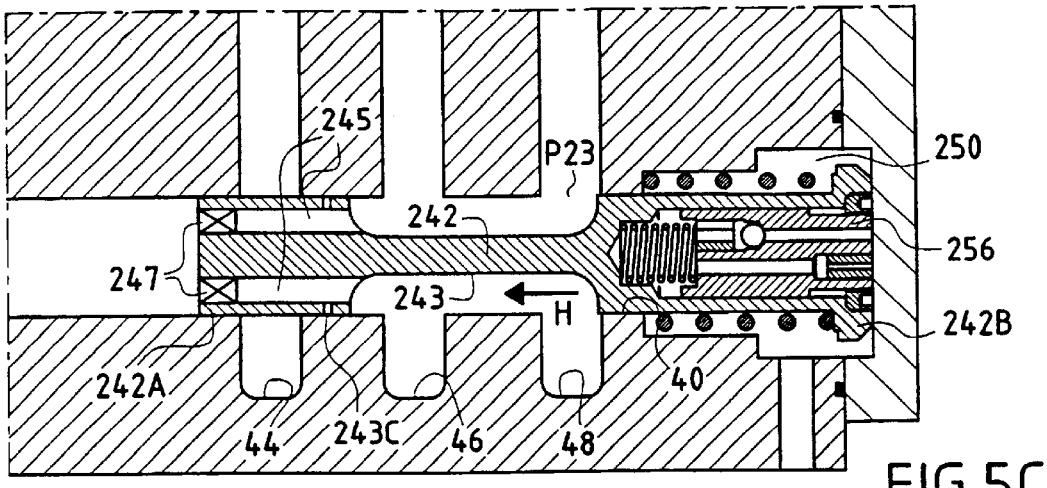

With reference to FIGS. 5A to 5C, there follows a description of a variant which allows the slide to be displaced in two stages.

The slide 242 of the cylinder-capacity selector device of these figures is disposed in the bore 40 which has the grooves 44, 46, and 48 constituting the first, second, and third communication ports. The cylindrical wall of the slide 242 has a groove 243 which, in the small cylinder-capacity position shown in FIG. 5A, provides substantially free communication between the first and second ports 44 and 46, and which, in the large cylinder-capacity position shown in FIG. 5C, puts the second and third ports 46 and 48 into communication. The passages P12 and P23 are thus open respectively in FIGS. 5A and 5C.

The slide 242 also has constrictions which allow a constricted flow between the first and second ports when it is in the intermediate position as shown in FIG. 5B. These constrictions are formed at the end of the groove 243 which is adjacent to the groove 44. Thus, longitudinal channels 245 are formed in the slide and extend between the groove 243 and the free end 242A of the slide situated at the same end as the groove 44. At this free end, these channels are plugged by plugs 247. The constrictions 243C are constituted by radial holes formed through the axially-extending wall of the slide between the groove 243 and the end 242A of the slide, and connected to the above-mentioned channels 245. The groove 243 and the constrictions 243C of the slide 242 constitute a variant for the groove 143 and the constrictions 143C of the slide 142, which variant is advantageous from the point of view of being simple to manufacture.

The means for controlling displacement of the slide 242 and enabling it to be displaced in two stages are described below with reference, in particular, to FIG. 5D. These control means are situated at the end 242B of the slide remote from its end 242A. They comprise a first control chamber 250 formed in the bore 40, and a second control chamber 252 formed in a cavity (a blind hole) itself formed at the end 242B of the slide. The chamber 252 is separated from the chamber 250 by a control piston 256 slidably mounted in the cavity 254. The first control chamber 250 is suitable for being connected to first pilot means to enable the assembly constituted by the slide 242 and the control piston 256 to move from the small cylinder-capacity position as shown in FIG. 5A in a first displacement step which is fast, at the end of which the control piston 256 is in an extreme position, specifically the position shown in FIGS. 5B and 5D. The free end 256A of the piston remote from the end 242A of the slide is then in abutment against the wall of the bore 40, which wall is constituted by the inside face of the cover 2D of the case.

The second control chamber 252 is suitable for being connected to second pilot means to enable the slide to move relative to the control piston in a second displacement step which is slow.

More precisely, the first displacement control means comprise a pilot duct 264 in communication with the chamber 250 and enabling said chamber to be fed or emptied, and the second pilot means comprise a pilot passage 262 suitable for putting the first and second chambers 250 and 252 into communication. As shown by a solid line in FIG. 5D, this passage can be made by a hole drilled through the piston 256, and having a constriction 260 placed therein. As indicated by fine lines in FIG. 5D, it is possible in a variant for the passage also to be implemented by one or more shallow grooves 262' formed in the surface (axially-extending face) of the control piston 256. The depth of this or these grooves can be determined so that said groove(s) directly constitute the above-mentioned constriction. There may be one or more axial grooves, or indeed, for example, one or more helical grooves as shown.

The description begins with displacement of the slide from its second position as shown in FIG. 5A (e.g. that which corresponds to the small cylinder-capacity) to its first position as shown in FIG. 5C (e.g. that which corresponds to the large cylinder-capacity). As can be seen in FIG. 5A, the volume of the chamber 250 is at a maximum so that the slide is pushed in the direction of arrow H. In FIG. 5A, the volume of the chamber 252 is also at a maximum and it can be seen that the control piston 256 is pushed so as to come into abutment against an abutment nut 258 secured to the end 242B of the slide.

Starting from this situation, in order to control displacement of the slide, the chamber 250 is emptied via the duct 264. This emptying enables the slide to move in the direction of arrow G until the free end 256A of the piston 256 comes into abutment against the cover 2D. This first displacement step is known as the "fast" displacement step since it is associated solely with emptying the chamber 250 and this can be done quickly via the duct 264. At the end of this fast displacement step, the slide is in its intermediate position, and as can be seen from FIG. 5B, while it is in this position the second and third grooves 46 and 48 are in communication with each other via the passage P23 whose section is already quite large, while the groove 44 is in communication with the grooves 46 and 48 solely via the constrictions 243C.

From this intermediate situation, in order to continue to displace the slide, it is necessary for the second control chamber 252 to be emptied. Fluid can flow from this chamber 252 via the second above-mentioned pilot means, with the fluid leaving the chamber via the passage 262 that is fitted with the constriction 260. The rate at which fluid can be emptied from the chamber 252 is thus limited, such that this emptying requires a certain amount of time which is a function of the flow diameter of the constriction 260 or of the depth of the above-mentioned grooves 262'. The second stage of slide displacement is thus slowed down relative to the first.

A spring or the like 266 is disposed in the chamber 252 and tends to urge the piston 256 out from this chamber. A spring 268 is disposed in the chamber 250 and co-operates with the slide 242 and has the effect of opposing an increase in the volume of the chamber 250.

Displacement of the slide 242 from its first position (large cylinder-capacity) as shown in FIG. 5C to its second position (small cylinder-capacity) as shown in FIG. 5A takes place as follows.

To push the slide 242 in the direction of the arrow H towards its second position, the chamber 250 is fed with fluid via the duct 264. The chamber 252 communicates with the chamber 250 and is thus also fed with fluid which tends to push the piston 256 out from the cavity 254. The above-mentioned passage 262 or grooves 262' can be insufficient, given the constrictions they present, to allow the volume of the chamber 252 to increase rapidly, so the second pilot means include a reverse control passage 272 fitted with check valve means 274 which allow pilot fluid to flow between the chambers 250 and 252 only in the direction for causing the slide to be displaced from its first position towards its second position.

FIGS. 5A to 5D thus show hydraulic control means which enable the displacement of the slide to be braked only in one displacement direction in which an intermediate stage takes place. In contrast, in the other displacement direction, displacement is fast. In addition, in the figures, a slide is shown for which, during the intermediate stage, only the section of the passage P12 between the first and second ports is constricted, while that of the passage P23 between the second and third ports is substantially free. Naturally, the shape of the slide could be modified in order to fit it, at both ends of the groove 243, with constrictions of the same type as the constrictions 243C, but possibly having different sections. Thus, in the intermediate stage, the two passages would have constricted sections.

FIGS. 6 to 10 are diagrams showing variants of the means for controlling the displacement of the slide in the cylinder-capacity selector device of the invention.

By way of example, it is considered in these figures that the first and second positions of the slide correspond respectively to the large cylinder capacity and to the small cylinder capacity. The disposition could however by reversed.

Figure 6:
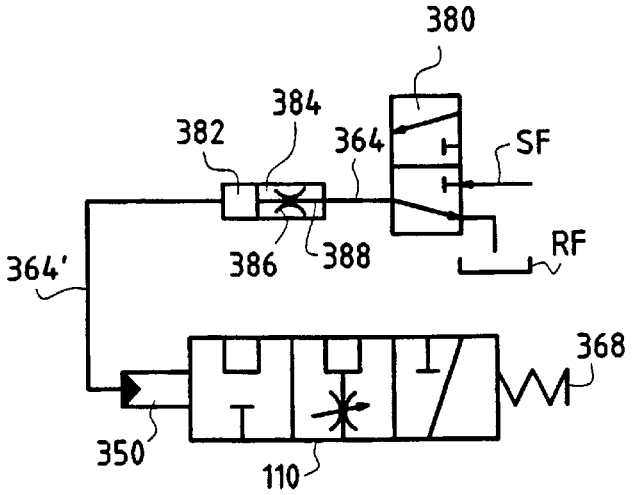

Thus, there can be seen in FIG. 6 the selector 110 of FIG. 2. In FIG. 6, reference 350 designates a control chamber connected to a pilot duct 364, and reference 368 designates a spring whose effect is to oppose filling of the chamber 350. These control means are fitted, for example, to the slide 142 of FIGS. 4A to 4C, with the control chamber 350 and the spring 368 being analogous respectively to the control chamber 150 and the spring 154. By means of a two-position selector 380, the pilot duct 364 can be connected to a source of fluid under pressure SF or to a tank without pressure RF.

In the variant of FIG. 6, the means for controlling displacement of the slide comprise means for measuring a volume of pilot fluid and designed to enable substantially free flow in the pilot duct 364 of a determined volume of fluid, at least in a first displacement direction corresponding to the slide being displaced from its second position towards its first position, and means for preventing an additional volume of fluid from flowing in said pilot duct 364 in said first flow direction other than via a first constriction.

Thus, in FIG. 6, the pilot duct 364 has a measuring chamber 382 in which there is located a measuring piston 384. The piston is shown in its second position, in which the pilot chamber 382 has a maximum volume and the pilot duct is connected to the tank RF. By way of example, FIGS. 6 to 9 show the situation in which the selector slide 110 is controlled to go from its small cylinder-capacity, second position to its large cylinder-capacity, first position by emptying the chamber 350. This constitutes an advantageous variant, but it must be understood that analogous means could be provided for opposite control.

In FIG. 6, the selector slide 110 occupies its large cylinder-capacity, first position while the volume of the chamber 350 is at a maximum, with the pilot duct 364 being connected to the fluid source SF by the selector 380 and the measuring piston 384 occupying its first position in which the measuring chamber 382 presents a minimum volume. Starting from this situation, when the pilot duct 364 is connected to the unpressured tank RF, the piston 384 is free to move towards the second position it occupies in FIG. 6, and the chamber 350 quickly empties out a first emptying volume corresponding to the volume of the measuring chamber 382 which fills substantially freely. Starting from this situation, emptying an additional volume of fluid from the chamber 350 is possible only via the constriction 386 which has an exhaust duct 388 formed through the piston 384 in the example shown. This makes it possible to implement the slow second displacement step where speed is a function of the flow section of the constriction 386.

Conversely, when the selector slide 110 is controlled to go from its large cylinder-capacity, first position to its small cylinder-capacity, second position, the means in place can also serve to obtain the same sequence of fast displacement followed by slow displacement of the slide.

Figure 7:
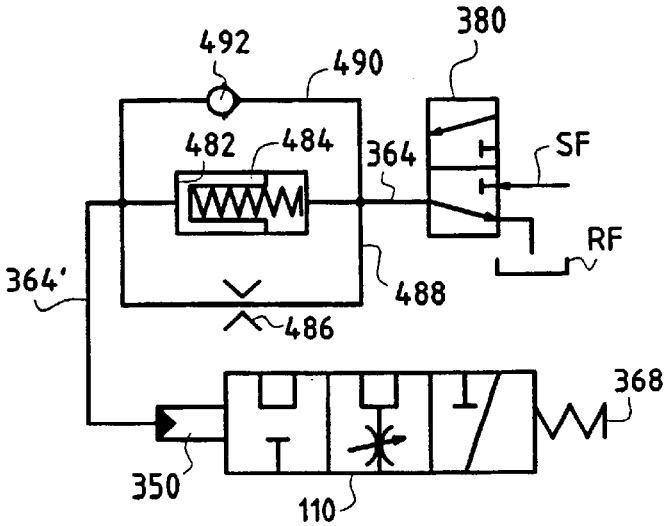

In FIG. 7, the exhaust duct is implemented by a bypass 488 fitted with a constriction 486 and connected in parallel with the chamber 482 on the pilot duct 364. Displacement of the selector slide 110 from its small cylinder-capacity, second position towards its large cylinder-capacity, first position is controlled in a manner analogous to that of FIG.

6. To control displacement of the slide in the opposite direction, the duct 364 is connected to the fluid source SF via the selector 380, thereby pushing back the piston 484 so as to reduce the volume of the chamber 482. A volume of fluid corresponding to the volume of said measuring chamber 482 is thus injected into the control chamber 350.

From this situation, the fluid chamber 350 can continue to be fed via the duct 488 and its constriction 486. Nevertheless, it may be desirable to ensure that the speed at which the chamber 350 fills is not limited by said constriction 486, so FIG. 7 shows a bypass duct 490 fitted with check valve means allowing pilot fluid to flow along said bypass duct 490 only in a second flow direction corresponding to displacement of the selector slide 110 from its first position towards its second position.

Figure 8:
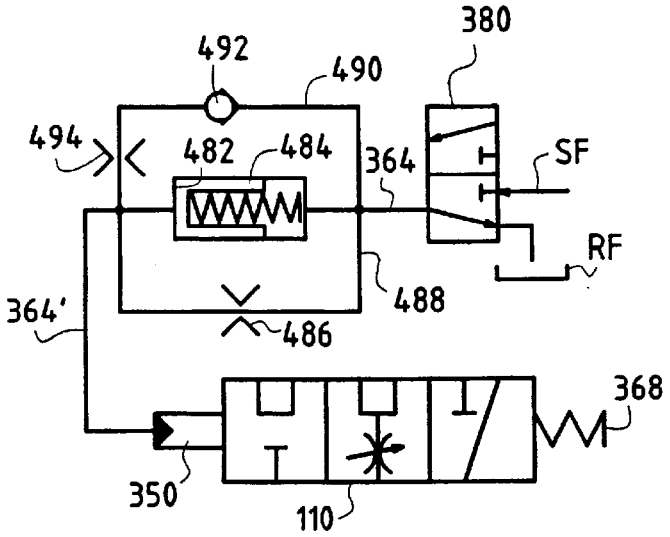

The variant of FIG. 8 is analogous to that of FIG. 7, except that the bypass duct 490 has a second constriction 494. Thus, the displacement speed of the selector slide 110 when going from its first position towards its second position is defined by the fluid feed of the duct 364' via the constrictions 486 and 494. In this case also provision can be made for a fast first displacement step associated with emptying the chamber 482 and for a slow second displacement step when passing from large cylinder capacity to small cylinder capacity.

Thus, the means for controlling displacement of the slide of the device in a variant of the invention that further comprises inverse measuring means (constituted in the example of FIG. 8 by the measuring chamber 482) designed to allow substantially free circulation in the pilot duct of a determined volume of fluid in a second displacement direction corresponding to displacement of the slide from its first position towards its second position, and means for allowing an additional volume of fluid to flow in the pilot duct in the opposite flow direction only via a second constriction. In the example of FIG. 8, these means are constituted by the check valve 492 and the constrictions 486 and 494.

FIG. 9 shows a variant giving the same facilities. The pilot duct 364 has a first measuring chamber 582 in which there is located a first measuring piston 584 suitable, under drive from a pilot fluid, for being displaced between first and second positions so as to cause a volume of fluid corresponding to the stroke of said first measuring piston 584 to flow in a first segment 364A of the pilot duct extending between the first measuring chamber 582 and the control chamber 350. When the first piston 584 is occupying its second pilot position, an additional volume of fluid can flow in the first segment 364A in the first flow direction only via the first constriction 586 which is disposed in said first segment 364A.

More precisely, in the example shown, the constriction 586 is disposed in a bypass 590 around the chamber 582. The first segment 364A of the pilot duct is fitted with first check valve means 591 which allow pilot fluid to flow along this segment 364A only in the first flow direction.

In addition, the pilot duct 364 has a second measuring chamber 582' in which there is disposed a second measuring piston 584' suitable, under the effect of a pilot fluid, for being displaced between first and second positions to cause a volume of fluid corresponding to the stroke of said second measuring piston 584' to flow in a second segment 364B of the pilot duct, extending between the second pilot chamber 582' and the control chamber 350. When this second position is in its second pilot position, an additional volume of fluid can flow in the second segment 364B in the second flow direction only via a second constriction 586' which is disposed in the second segment 364B. More precisely, in the example shown, the second constriction 586' is disposed in a bypass duct 590' bypassing the chamber 582'. The second segment 364B of the pilot duct is fitted with second check valve means 592 allowing pilot fluid to flow in the second flow direction only.

Thus, the volume of the first pilot chamber 582 defines a fast first displacement step during displacement of the slide from its first position towards its second position, while the flow section of the first constriction 586 defines the slow second displacement step of said slide in the same direction. Conversely, the volume of the second pilot chamber 582' defines a fast first displacement step during displacement of the selector slide from its first position towards its second position, while the flow section of the second constriction 586' determines the slow second displacement step in the same displacement direction.

As can be seen in FIG. 9, the means for controlling displacement of the selector slide 110 also advantageously comprise pressure reducing means 595 for limiting the head loss on either side of the second constriction 586'. Analogous means could be located on the bypass duct 490 of FIG. 8.

Each of the control devices of FIGS. 6 to 9 can be used for controlling a plurality of measures simultaneously. Under such circumstances, it suffices to adapt the volumes of the measuring chambers accordingly.

The selector 610 of FIG. 10 differs from the selector 110 of FIGS. 6 to 9 and of FIG. 2 by the fact that, in the central intermediate position, it has a constriction on each of the two passages between, firstly, the first and second ports and, secondly, the second and third ports. The two constrictions are preferably different. Naturally, the selector 110 of FIGS. 6 to 9 could be replaced by the selector 610. As in FIG. 2, FIG. 10 shows the main ducts 124 and 126 for the two cylinder capacities 102 and 103 of the motor. A leakage return duct 627 is also shown. The three ports of the selector 610 are similar to those of the selector 110.

In FIG. 10, displacement of the selector slide 610 is controlled by electronic control means. In the example shown, the control means comprise a control unit UC and, as a function of the control information that it receives, they control an electrically-controlled valve 630. The selector 610 is connected to the electrically-controlled valve via a hydraulic pilot duct 664. The displacement of the electrically-controlled valve is progressive between two extreme positions.

In the first extreme position shown in FIG. 10, the pilot duct 664 is put into communication with the leakage return duct 627. Consequently, the selector 610 occupies, under the effect of resilient return means, its first position in which the second and third ports communicate freely while being isolated from the first. When the electrically-controlled valve 630 is displaced towards its other extreme position, the pilot duct 664 is progressively connected to an auxiliary pressure duct 629, e.g. a duct fed by the booster pump of the circuit such as the pump 101 of FIG. 2. In this case, feeding the pilot duct 664 with fluid displaces the selector towards its second position.

The control unit UC controls the displacement of the electrically-controlled valve 630 as a function of the information that it receives, e.g. via sensors 640 and 640'. For example, the sensor 640 can supply it with information relating to the pressure in the pilot duct 664. From data previously stored in memory, the control unit UC knows, as a function of said pressure, the position of the selector 610. The displacement of the selector can also be servocontrolled by the control unit as a function of the pressure measured by the sensor 640. As a function of prestored data, the control unit can, by controlling the pressure in the duct 664, also maintain the selector 610 in a position corresponding to the intermediate stage during a predetermined period of time.

The control unit UC can also control the electrically-controlled valve 630 as a function of other parameters, such as those which are delivered by the sensor 640' relating, for example, to the pressure, temperature, or fluid flow in a duct of the motor.

The control unit UC can also control the electrically-controlled valve 630 in accordance with a programmed relationship taking account of the characteristics of the vehicle.

In general, the electronic control means of the slide, shown by way of example in FIG. 10, comprise detector means which act, during a displacement of the slide where one of the passages between the first and second ports and between the second and third ports is designed to be constricted in the intermediate stage, to detect information making it possible to determine at least one of the parameters constituted by the position of the selector slide, the displacement speed of the slide, the loss of head through said passage designed to be constricted, the flow rate through the passage, the pressure or the fluid flow rate in a duct of the hydraulic motor, the temperature of the fluid in a duct of the hydraulic motor, or even the output speed of the motor. The electronic control means also include control means such as the control unit UC, which are capable of influencing the displacement speed of the selector slide as a function of the information detected.

The above-mentioned non-exhaustive parameters make it possible, as a function of appropriate programming of the microprocessor or as a function of prestored data abacuses, for the state of the system to be known and for the displacement of the selector to be controlled as a function of said state. For example, when a state corresponding to the start of the intermediate stage is detected, the control unit can slow down displacement of the slide by ceasing to feed the duct 664 so as to maintain a substantially constant pressure in said duct. When said stage of almost stopping the displacement of the slide corresponding to the intermediate stage has lasted long enough with regard to the prestored operating parameters, the control unit can once again cause the electrically-controlled valve 630 to operate in order to increase or decrease the pressure in the duct 664 so as to cause the selector to be displaced further in one direction or the other.

FIG. 10 shows only one example of control means that use electronic means.

Direct electronic or electromechanical control can also be provided, e.g. a stepper motor with a displacement system such as a screw-and-nut system, to act directly on the selector slide. Control can also be provided by a servo-limiter or a servo-valve. In general, a servo-control system using a servo-mechanism can be provided. For example, a servo-reducer can be used which is a pressure reducer controlled by means such as the core of an electromagnet, itself controlled by DC or by pulses as a function of servo-control data.

A hydraulic control system can also be used by replacing the control unit UC and the electrically-controlled valve 630 in FIG. 10 with any type of controlled pressure system suitable for progressive hydraulic control.

As shown above, it is advantageous for the displacement of the selector slide to include a fast displacement step followed by a slow displacement step, and, itself, possibly followed by a new fast displacement step.

Amongst other things, the system described enables the slide to be positioned (without moving) for a defined period of time. It also makes a negative-speed displacement possible (i.e. a reverse displacement).

By way of indication, curve V1 in FIG. 11 shows how the displacement speed of the slides vary during displacement in a first direction, e.g. from its second position to its first position. Curve V2 shows how the displacement speed of the slides varies during displacement in the opposite direction.

In both displacement directions, speed increases rapidly until a high value is reached so as to implement a fast first displacement step, as shown by portions V11 or V21 of the curves. When the slide reaches a position corresponding to the start of the intermediate stage, the speed decreases rapidly so as to be returned to a lower value, corresponding respectively to the portions V12 or V22 of the curves. The speed remains at a low value during the lapse of time that the intermediate stage lasts in either displacement direction. At the end of the intermediate stage, the speed increases rapidly once again so as to return to a high value corresponding respectively to the portions V13 or V23 of the curves. Thus, once the intermediate stage has lasted for long enough to enable sufficient fluid flow to avoid a jarring effect, the displacement of the slide becomes rapid once again so as to prevent the total duration of the cylinder-capacity changeover from being too long. In the example in FIG. 11, an intermediate stage takes place in each of the two displacement directions.

The control means enabling an intermediate stage to be obtained in both displacement directions of the selector slide can either be electronic means or else can be combined electronic and hydraulic means of the above-mentioned type. The control means can also be hydraulic means such as those shown in FIG. 12.

In the example shown, the cylinder-capacity selector device in which the slide 742 is disposed has its bore 740 disposed in alignment with the rotary axis 710 of the cylinder block at the center of the distributor 716 of the motor. In the example, the bore 740 includes three communication ports, respectively 744, 746, and 748.

The first port 744 is connected to the distribution ducts of the first group, such as duct 721, which are in permanent communication with each other via groove 718. The third port 748 is connected to the distribution ducts of the third group, such as duct 722, which are in permanent communication with each other via groove 720. The second communication port 746 is in permanent communication with the distribution ducts of the second group, such as duct 723, which are in permanent communication with each other via holes 719.

Figure 12:
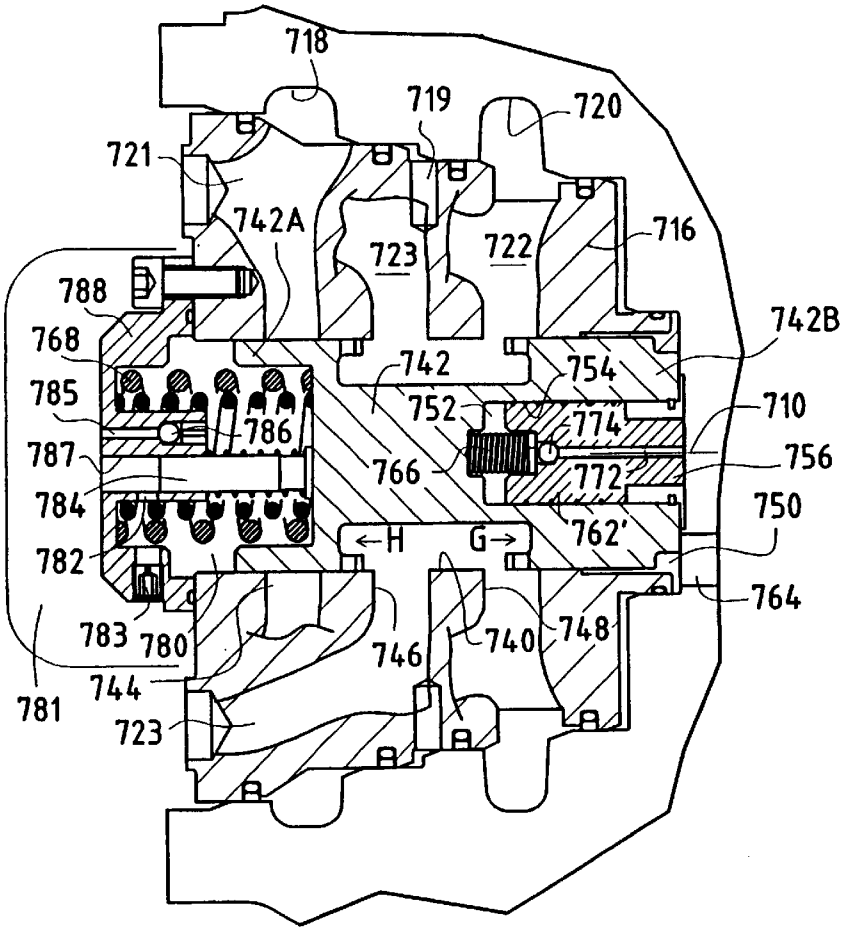
FIG. 12 is a fragmentary view in axial section of a motor comprising a cylinder-capacity selector device of the invention fitted with hydraulic control means for controlling the displacement of the slide, enabling an intermediate displacement stage to be implemented in both of the displacement directions of the slide.

For problems of accessibility, the hydraulic control means which are shown in FIG. 12 are advantageously disposed on such a central selector. However, the same principle could be adopted for an off-center selector, positioned like that shown in FIG. 1.

The first hydraulic control means situated at the first end 742B of the slide, beyond the port 748 are, overall, analogous to those of FIGS 5A to 5D.

A first control chamber 750 is formed between the end 742B of the slide and the end of the bore 740. The chamber is connected to a pilot duct 764. Feeding the chamber 750 with fluid tends to displace the slide in the direction of arrow H, against the return force exerted by the return springs 768 disposed at the other end 742A of the slide.

The second control chamber 752 is formed in the cavity 754 of the end 742B of the slide. It is separated from the first chamber by a control piston 756 disposed in the cavity 754. As in the variant of FIG. 5D, the second pilot means are constituted by a helical groove 762'. The return spring 766, the reverse control passage 772, and the valve 774 are respectively analogous to the spring 266, the passage 272, and the valve 274 of FIG. 5D.

Figure 5D:
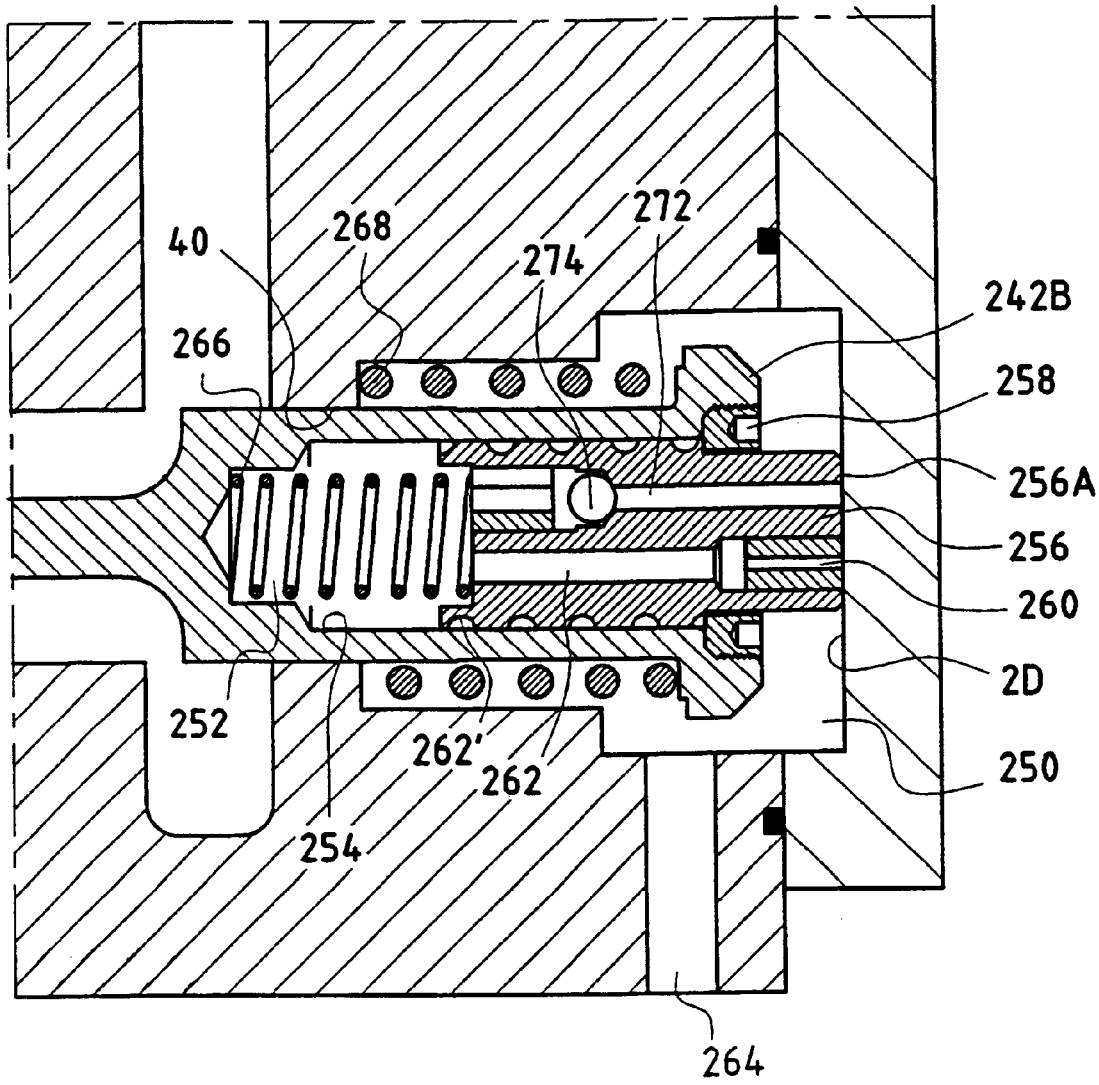

As in the case of FIG. 5D, the control means comprising the two chambers 750 and 752 enable the displacement of the slide to be controlled in the displacement direction G in a fast displacement step followed by a slow displacement step.

The control means serving to control the displacement of the slide 742 with an intermediate stage in the other direction, along arrow H, comprise a third control chamber 780 formed in the bore 740, at the other end 742A of the slide. The chamber 780 is connected to a fluid reserve 781 in a fluid flow direction between the chamber 780 and the reserve 781 which controls a fast displacement step and a slow displacement step of the slide.

The connection means between the chamber and the reserve comprise a substantially free first connection portion 782 and a second portion 783 fitted with a constriction. They also comprise closure means 784 which enable the first portion 782 to be closed as a function of the position of the slide 742 so that, in said closure situation, the fluid flow between the third control chamber 780 and the fluid reserve 781 is allowed, in said fluid flow direction, only through the constriction 783.

In the example shown, the reserve 781 is merely constituted by the inside space of the case of the motor formed between the cylinder block and the distributor, normally filled with fluid. The flow direction in which the third chamber controls the displacement of the slide is that of the emptying direction of said third chamber towards said space 781.

In contrast, the chamber 780 can be rapidly fed with fluid via a feed passage 785 which, by means of a valve 786, enables fluid flow only in the direction going from the space 781 to the chamber 780.

In the example shown, the closure means are constituted by a rod 784 which is displaced with the slide 742 by sliding in a bore 787 that extends between the chamber 780 and the fluid reserve 781. The substantially free first connection part is constituted by one or more holes 782 in the wall of the bore, which, while they are not covered by the rod 784, enable substantially free fluid flow between the chamber 780 and the reserve 781.

Starting from the situation in FIG. 12, it is understood that when the slide 742 is displaced in the direction H, the rod 784 covers the holes 782 so that the chamber 780 can no longer be emptied except via the constrictions 783.

The bore 787, as well as the duct 785 and the constriction 783, are formed in a cover 788 which is fixed to the distributor 716 in order to close the bore of the selector 740 on the side of the end 742A of the slide. In general, the connection means can be formed in a member secured to the bore 740, and the closure means can comprise a closure rod which is displaced with the slide.

Figure 13:
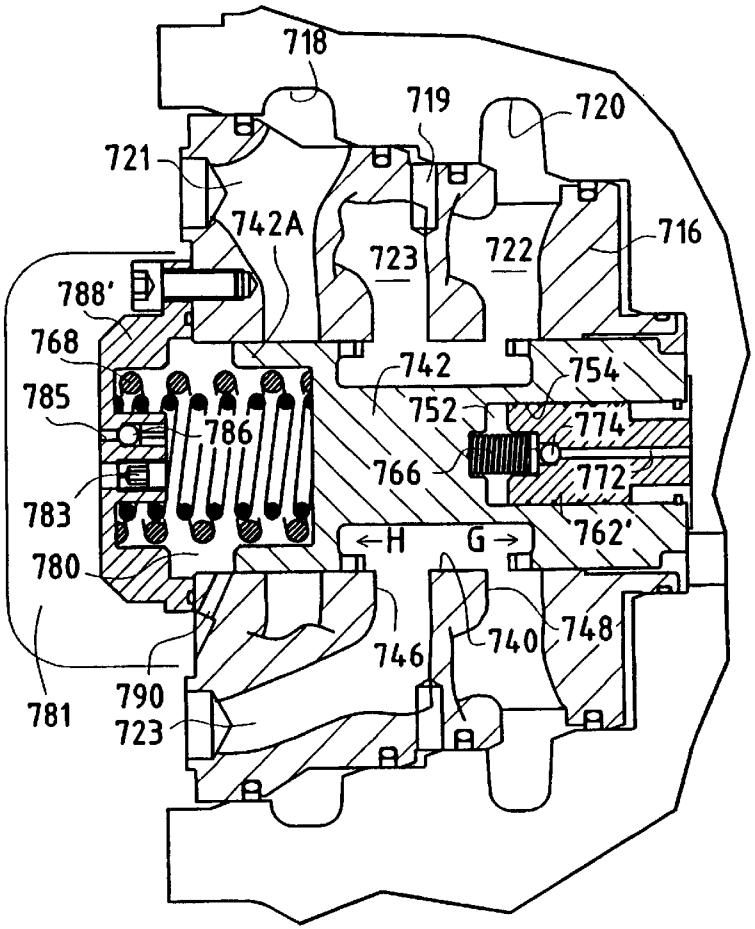
FIG. 13 shows a variant of FIG. 12.

FIG. 13 shows a variant of FIG. 12, in which the control means situated at the end 742B of the slide remain unchanged. At the other end of the slide, the chamber 780 also remains unchanged, and the cover 788' includes a reverse connection flow 785 and an anti-return valve 786, enabling the fluid to flow in the filling direction only of the chamber 780. In addition, the constriction 783 is disposed in the cover.

This time, the substantially free first connection portion of the connection means is made by a hole 790 which extends between the chamber 780 and the fluid reserve 781, and which, when the slide is displaced in the direction H, can be covered by the wall of the end 742A of the slide, in which case the chamber 780 can no longer be emptied except via the constriction 783.

So long as it is not covered by the wall of the slide, the passage 790 thus enables the chamber to be emptied substantially freely. In addition, while it is covered by the wall of the slide, it enables possible leaks that occur between the wall of the slide and the wall of the bore 740 to be evacuated into the reserve 781. Thus, said leaks do not cause an increase in pressure in the chamber 780 and thus do not disrupt operation, without it being necessary to add a seal between the wall of the bore 740 and the periphery of the slide. For this reason, the bore 790 can also be provided in the variant of FIG. 12, in addition to the bores 782.

Figure 14B:
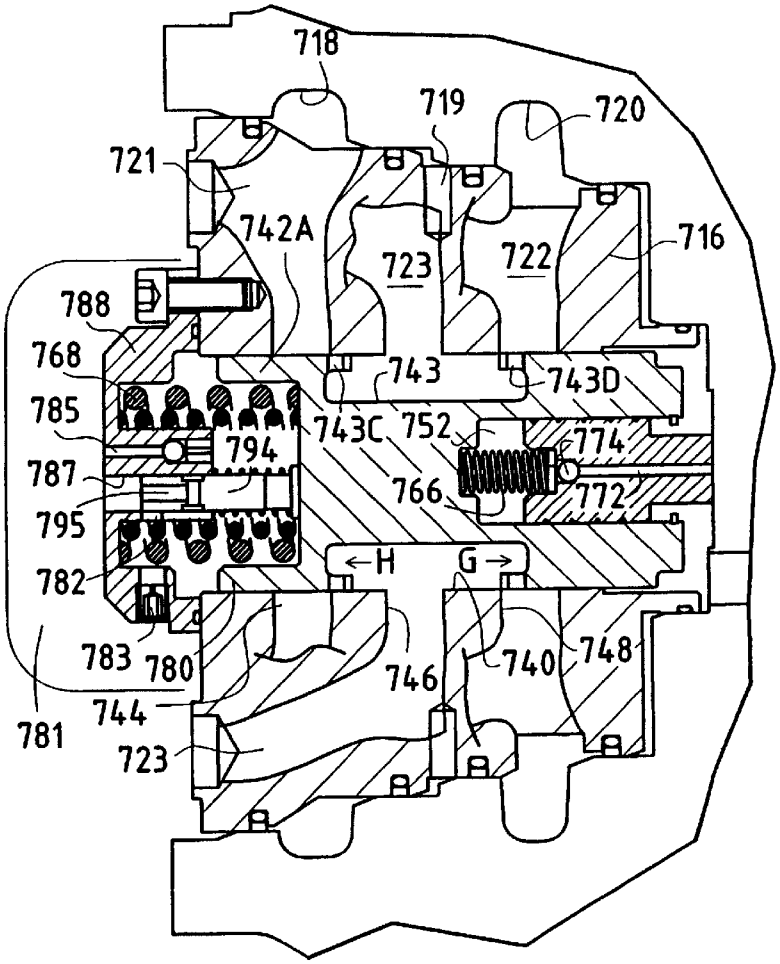
FIGS. 14A, 14B, 14C, and 14D are fragmentary views in axial section of variants of FIGS. 12 and 13, showing four distinct positions of the cylinder-capacity selector slide.
Figure 14A:
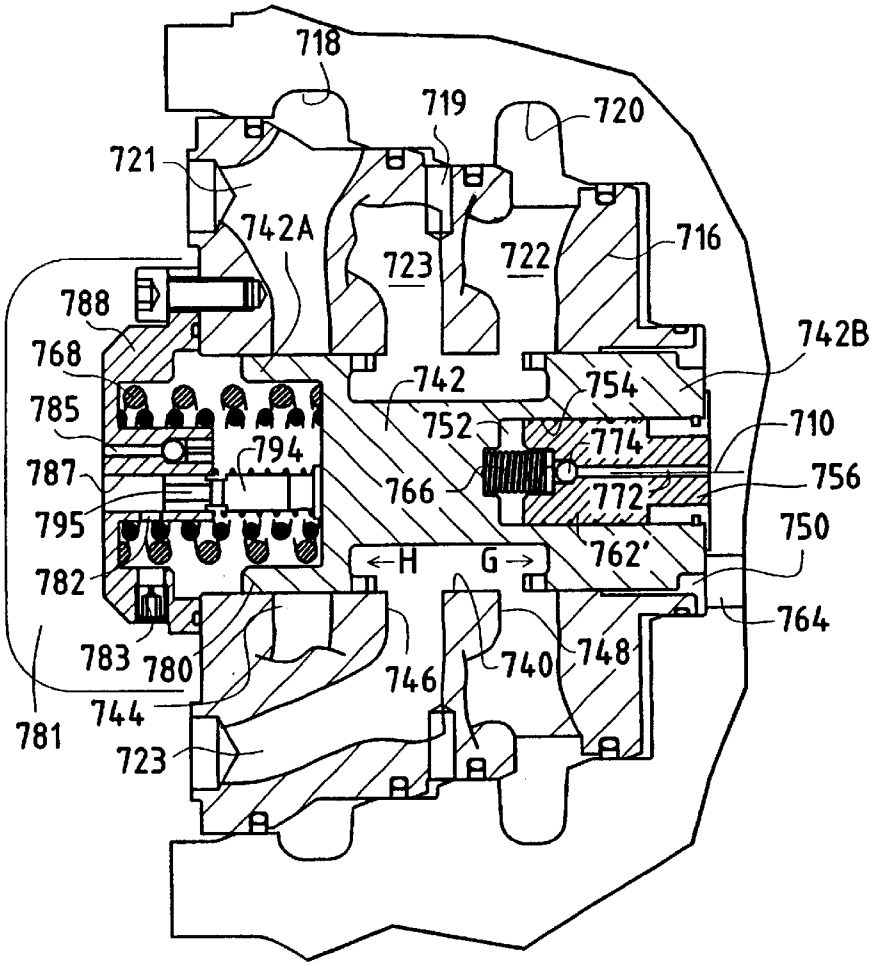

FIGS. 14A to 14B show yet another variant of the system of FIG. 12. The first and second control chambers 750 and 752 are analogous to those of FIGS. 12 and 13. The disposition of the third control chamber 780 and that of the cover 788 are also the same as in that figure.

However, the variant of FIGS. 14A to 14B makes it possible, in the displacement direction of the slides corresponding to the emptying of the chamber 780 (direction H), not only to obtain a fast first displacement step followed by a slow displacement step, but also to obtain a fast second displacement step which follows the slow displacement step. The closure rod 794 has an internal duct 795 which opens firstly on its axial periphery, and secondly at its free end remote from the slide 742.

FIG. 14A shows the first position of the selector, e.g. in the large cylinder-capacity situation, in which the distribution ducts of the second and third groups 723 and 722 communicate freely via the second and third communication ports 746 and 748 which are connected via the groove 743 of the slide.

In this situation, the volume of the third control chamber 780 is at a maximum, while that of the chamber 750 is at a minimum. The slide has thus been displaced over its maximum amplitude in the direction G.

Starting from this situation, in order to cause the slides to be displaced in the direction H, the pilot duct 764 is fed so as to increase the volume of the chamber 750. However, such displacement is possible only if the chamber 780 is emptied correctly. To begin with, the chamber is emptied without difficulty via the bores 782, which are not yet covered by the wall of the rod 794.

At the end of the fast first displacement step, the situation shown in FIG. 14B is reached, in which the cylindrical wall of the rod 794 covers the holes 782. The displacement of the slide then takes place as a slow displacement step, in which the chamber 780 can only be emptied via the constriction 783. During the slow displacement step, the first and second communication ports 744 and 746 communicate with each other via constriction means such as the constriction passages 743C formed in the slide 742 in the same way as the holes 243C of FIGS. 5A to 5D. Simultaneously, the second and third communication ports 746 and 748 also communicate with each other via constrictions, such as the holes 743D, which are analogous to the holes 743C but are formed at the other end of the groove 743. The holes 743C and 743D are distributed over the circumference of the edge of the groove 743. To define different constriction sections in the intermediate stage, the holes 743C and 743D can have different sections or can be provided in greater or smaller numbers.

The slow displacement step continues for as long as the passage 782 is covered by the cylindrical wall of the rod 794. It can be seen that when the slide is displaced even further in the direction H than in FIG. 14B, the ends of the duct 795 which open on the cylindrical wall of the rod 794 come to face the passage 782 and thus reestablish substantially free communication, enabling the chamber 780 once again to be emptied rapidly (this situation is identical to that shown in FIG. 14D). When communication is again established, the displacement of the slide in the direction H continues as a fast second displacement step.

Figure 14D:
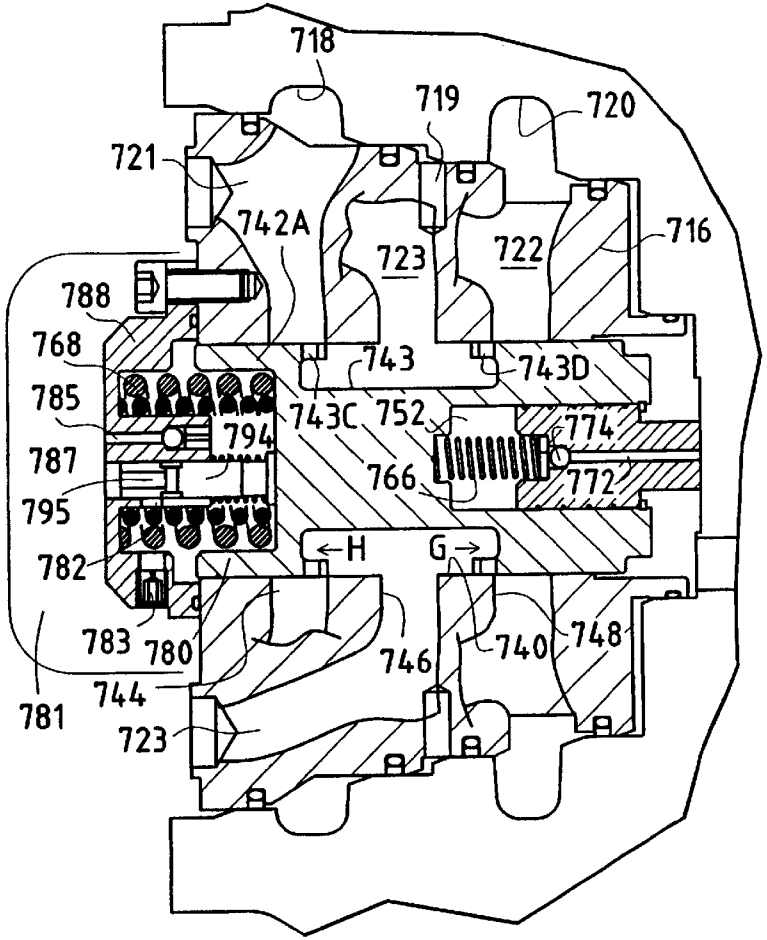
Figure 14C:
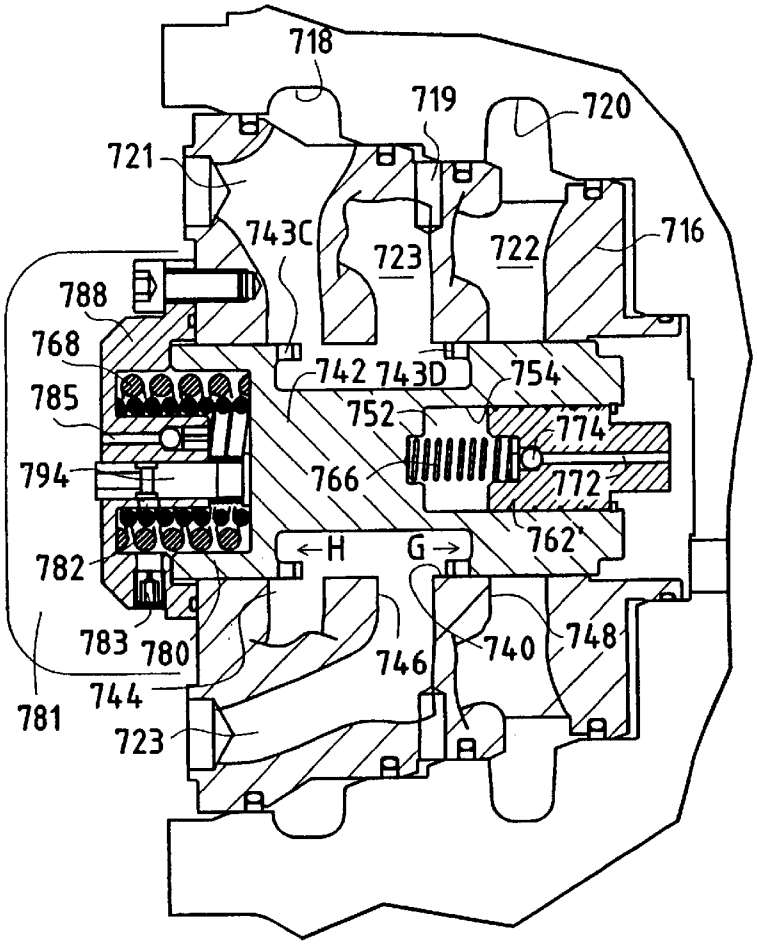

FIG. 14C shows the situation starting from the new fast displacement step, in which the slide 742 has been displaced in the direction H until it reaches its end of stroke. In the second stable position of the slide, e.g. its small cylinder-capacity position, the distribution ducts of the first and second groups communicate freely via the communication ports 744 and 746 which are connected via the groove 743. It should be noted that the slide has been displaced by the chamber 750 being fed with fluid, and because of the position of the valve 774, the second control chamber 752 is also filled. Starting from the situation in FIG. 14C, the displacement of the slide in the direction G, towards its first position, takes place by emptying the chambers 750 and 752, i.e. by connecting the pilot duct 764 to a duct such as a leakage return duct.

As in the case of FIGS. 5A to 5C, the chamber 750 is firstly emptied rapidly until the free end of the piston 756 comes into abutment against the end of the bore 740, in the situation in FIG. 14D. Starting from this moment, the chamber 750 can only be emptied with the chamber 752 which can itself only be emptied by means of two pilot means such as the helical grooves 762', which allow fluid to flow only at a constricted rate.

Thus, in the example shown, the displacement of the slide from its second position to its first position comprises a fast first displacement step followed by a slow second displacement step. During the displacement, the third control chamber 780 is filled without difficulty via the reverse flow duct 785. The situation in FIG. 14D is that of the start of the slow displacement step, which corresponds to the intermediate stage. In this stage, the first and second communication ports communicate via the above-mentioned constrictions 743C, while the second and third communication ports communicate via the constrictions 743D.

What is claimed is:

1. A selector device for selecting the cylinder capacity of a hydraulic motor having at least two active operating cylinder capacities, the motor comprising at least two main ducts respectively constituting a fluid feed duct and a fluid exhaust duct, the selector device comprising a slide placed in a bore into which at least three communication ports open out, suitable, via distribution ducts of the motor, for establishing selective communication between the main ducts and the cylinders of said motor, a third communication port being designed to be connected to one of the main ducts of the motor, the device having selector means which, in a first stable position of the slide, put a second communication port into communication with the third communication port via a passage between the second and third ports, while isolating said second and third ports from a first communication port, and which in a second stable position of the slide, put the second communication port into communication with the first communication port via a passage between the first and second ports while isolating said first and second ports from the third communication port, the selector means being constituted in such a manner that during displacement of the slide between said stable positions, there exists a temporary situation in which both the passage between the first and second ports and the passage between the second and third ports are open simultaneously;

the device comprising means effective, in at least one displacement direction of the slide between its first and second stable positions, to maintain said temporary situation for a time lapse in an intermediate stage during which the section of at least one of the passages constituted by the passage between the first and second ports and by the passage between the second and third ports is constricted.

2. A device according to claim 1, wherein, during the intermediate stage, the section of one of the passages between the first and second ports and between the second and third ports is constricted, while the fluid flow in the other of said passages is substantially free.

3. A device according to claim 1, wherein, during the intermediate stage, the sections of each of the passages between the first and second ports and between the second and third ports are constricted.

4. A device according to claim 1, including means for controlling the displacement of the slide in the direction that includes the intermediate stage, said means being capable of implementing a fast first displacement step of the slide from its initial position to a position corresponding to the start of the intermediate stage, and a braking displacement step during which said intermediate stage takes place.

5. A device according to claim 4, wherein the control means are also capable of implementing a fast second displacement step of the slide after the intermediate stage.

6. A device according to claim 1, wherein the section which is constricted during the intermediate stage remains substantially constant during at least part of the duration of said intermediate stage.

7. A device according to claim 1, wherein one of the passages between the first and second ports and between the second and third ports having a constricted section during the intermediate stage has a first and second portion, the first portion enabling fluid to flow substantially freely, being open in the initial position of the slide before a displacement comprising the intermediate stage, and being closed in the intermediate stage, the second portion being fitted with a constriction which defines the opening of said constricted passage during the intermediate stage.

8. A device according to claim 1, wherein the control means for controlling displacement of the slide comprise a first control chamber formed in the bore at one end of the slide, and a second control chamber formed in a cavity at said end of the slide and separated from the first chamber by a control piston disposed in said cavity, the first control chamber being suitable for being connected to first pilot means to enable the assembly constituted by the slide and the control piston to be displaced during a fast first displacement step, at the end of which the control piston is in an extreme position, and the second control chamber being suitable for being connected to second pilot means to enable the slide to be displaced relative to the control piston in a slow second displacement step.

9. A device according to claim 8, wherein the second pilot means include a constriction designed to be interposed on the flow path of a pilot fluid in the second displacement step of the slide.

10. A device according to claim 5, wherein a second pilot means comprise a pilot passage suitable for putting a second control chamber into communication with a first control chamber.

11. A device according to claim 9, wherein the second pilot means comprise a pilot passage suitable for putting the a second control chamber into communication with the first control chamber, and wherein the pilot passage comprises a groove formed in the surface of the control piston.

12. A device according to claim 8, wherein the second pilot means comprise a return control passage fitted with check valve means allowing pilot fluid to flow in said passage only in the direction favoring displacement of the slide in the direction opposite to the direction in which said fast displacement and slow displacement steps are controlled via the first and second control chambers.

13. A device according to claim 1, wherein the control means for controlling the displacement of the slide comprise a third control chamber formed in the bore at one end of the slide, connection means for connecting the chamber to a fluid reserve in a fluid flow direction between said chamber and said reserve which causes the slide to perform a fast displacement step and a slow displacement step, the connection means comprising a substantially free first connection portion and a second portion having a constriction, and closure means for closing said first portion as a function of the position of the slide and thus for allowing the fluid to flow in said flow direction between the third control chamber and said fluid reserve only through the constriction.

14. A device according to claim 13, wherein the connection means are formed in a member secured to the bore, and wherein the closure means comprise a closure member that is capable of being displaced with the slide.

15. A device according to claim 13, also including a reverse connection passage having anti-return valve means, enabling fluid to flow between the third control chamber and the fluid reserve in the direction opposite to said fluid flow direction causing the slide to perform a fast displacement step and a slow displacement step via the third chamber.

16. A device according to claim 8, wherein the control means for controlling the displacement of the slide comprise a third control chamber formed in the bore at one end of the slide, connection means for connecting the chamber to a fluid reserve in a fluid flow direction between said chamber and said reserve which causes the slide to perform a fast displacement step and a slow displacement step, the connection means comprising a substantially free first connection portion and a second portion having a constriction, and closure means for closing said first portion as a function of the position of the slide and thus for allowing the fluid to flow in said flow direction between the third control chamber and said fluid reserve only through the constriction, wherein the first and second control chambers are formed at a first end of the slide and are designed to cause the slide to be displaced in a first displacement direction having a first intermediate stage, and wherein the third control chamber is formed at the other end of the slide and is designed to cause the slide to be displaced in the opposite direction for a displacement having a second intermediate stage.

17. A device according to claim 1, wherein the control means for controlling displacement of the slide comprise a control chamber connected to a pilot duct, means for measuring a volume of pilot fluid and designed to enable a determined volume of fluid to flow substantially freely in the pilot duct in at least a first flow direction causing the slide to be displaced in a first direction including a first intermediate stage, and means for allowing an additional volume of fluid to flow in the pilot duct in said first flow direction only via a first constriction.

18. A device according to claim 17, wherein the pilot duct has a measuring chamber in which there is disposed a measuring piston suitable, under the effect of a pilot fluid, for being displaced between a first position and a second position to cause a volume of fluid corresponding to the stroke of said piston to flow in a segment of pilot duct extending between the measuring chamber and the control chamber, and wherein, when the measuring piston is occupying its second pilot position, an additional volume of fluid can flow in said segment, at least in the first flow direction, only via the first constriction.

19. A device according to claim 18, wherein the measuring chamber is connected to a bypass duct fitted with check valve means allowing pilot fluid to flow in said duct only in a second flow direction causing the slide to be displaced in a second direction opposite to said first displacement direction.

20. A device according to claim 17, wherein the control means for controlling displacement of the slide further comprise inverse measurement means for allowing substantially free circulation of a determined volume of fluid in the pilot duct in a second flow direction causing the slide to be displaced in a second displacement direction opposite to the first displacement direction and including a second intermediate stage, and means for allowing an additional volume of fluid to flow in the pilot duct in said second flow direction only via a second constriction.

21. A device according to claim 19, wherein the control means for controlling displacement of the slide further comprise inverse measurement means for allowing substantially free circulation of a determined volume of fluid in the pilot duct in a second flow direction causing the slide to be displaced in a second displacement direction opposite to the first displacement direction and including a second intermediate stage, and means for allowing an additional volume of fluid to flow in the pilot duct in said second flow direction only via a second constriction, and wherein the bypass duct is fitted with a second constriction.

22. A device according to claim 20, wherein the pilot duct has a first measuring chamber in which there is disposed a first measuring piston suitable, under the effect of a pilot fluid, for being displaced between a first position and a second position to cause a volume of fluid corresponding to the stroke of the first measuring piston to flow in a first segment of the pilot duct extending between the first measuring chamber and the control chamber, wherein, when said first piston is in its second pilot position, the flow of an additional volume of fluid in said first segment and in the first flow direction is possible only via the first constriction which is disposed in said first segment, which segment is fitted with first check valve means allowing the pilot fluid to flow only in the first flow direction, wherein the pilot duct has a second measuring chamber in which a second measuring piston is disposed which is suitable under the effect of a pilot fluid for being displaced between a first position and a second position to cause a volume of fluid corresponding to the stroke of said second measuring piston to flow in a second segment of the pilot duct extending between the second pilot chamber and the control chamber, and wherein, when said second position is in its second pilot position, an additional volume of fluid can flow in said second segment in said second flow direction only via a second constriction which is disposed on said second segment, which segment is fitted with second check valve means allowing pilot fluid to flow only in the second flow direction.

23. A device according to claim 21, wherein the control means for controlling displacement of the slide further comprise pressure reducer means for limiting the head loss across the second constriction.

24. A device according to claim 1, wherein the control means for causing the slide to be displaced comprise electronic control means.

25. A device according to claim 24, wherein the control means for causing the slide to be displaced comprise a servo-mechanism.

26. A device according to claim 24, wherein the control means for controlling displacement of the slide comprise detector for, during displacement of the slide, during which one of the passages between the first and second ports and between the second and third ports is designed to be constricted during the intermediate stage, detecting information making it possible to determine at least one of the parameters constituted by the position of the slide, the displacement speed of the slide, the loss of head through said passage, the flow rate through the passage, the pressure or the fluid flow rate in a duct of the hydraulic motor, the temperature of the fluid in a duct of the hydraulic motor, or even the output speed of the motor, and electronic control means which are capable of influencing the displacement speed of the slide as a function of the information detected.

27. A device according to claim 24, wherein the control means for controlling the displacement of the slide comprise a control duct that is capable of being fed with fluid under pressure so as to urge the displacement of the slide in a displacement direction that is against the return means, and wherein the control means are capable of controlling the fluid flow in said duct as a function of the information detected by the detector means.

28. A hydraulic motor having at least two operating cylinder capacities, and including a selector device according to claim 1.

29. A selector device for selecting the cylinder capacity of a hydraulic motor having two active operating cylinder capacities, the device comprising three groups of distribution ducts and having two main ducts respectively constituting a fluid feed duct and a fluid exhaust duct, the distribution ducts of the first group being permanently connected to one of said main ducts, while the distribution ducts of the third group are permanently connected to the second of said main ducts, the cylinder-capacity selector device comprising a slide placed in a bore having three communication ports respectively designed to be permanently connected to each of the three groups of distribution ducts, the selector slide being suitable for being displaced in said bore between a first stable position of small cylinder capacity, the device having selector means which, in the first stable position, put the first and third communication ports into communication via a passage between the second and third ports, while isolating the first communication port from said second and third ports, and which in the second position of the slide, put the first and second communication ports into communication via a passage between the first and second ports while isolating the third port from said first and second ports, said selector means being constituted in such a manner that during displacement of the slide between said first and second positions of the slide, there exists a temporary situation in which both the passage between the first and second ports and the passage between the second and third ports are open simultaneously;

the device being constructed in such a manner that during displacement of said slide from its second position to its first position, there exists an intermediate stage during which the passage between the second and third ports allows substantially free communication between the second and third ports, while the passage between the first and second ports forms a constriction, and the device comprising means for slowing down displacement of the slide during this intermediate stage.

30. A device according to claim 29, wherein the passage between the first and second ports has a first portion which is open in the second position of the slide and which, in said position, allows substantially free communication between the first and second ports, said first position being closed while the passage between the second and third ports is being opened, the passage between the first and second ports further including a second portion fitted with constrictions putting the first and second ports into communication during the intermediate stage.

31. A device according to claim 29, comprising control means for controlling displacement of the slide and suitable for causing the slide to move from its second position to its first position in a fast first displacement step followed by a slow second displacement step, the displacement speed of the slide in said second step being no more than one-third the displacement speed in the first step.

32. A device according to claim 29, wherein a second pilot means comprise a return control passage fitted with check valve means allowing pilot fluid to flow in said passage only in the direction for causing the slide to be displaced from its first position towards its second position.

33. A device according to claim 29, wherein a control means for controlling displacement of the slide comprise a control chamber connected to a pilot duct, means for measuring a volume of pilot fluid and designed to enable a determined volume of fluid to flow substantially freely in the pilot duct in at least a first displacement direction corresponding to the slide being displaced from its second position towards its first position, and means for allowing an additional volume of fluid to flow in the pilot duct in said first flow direction only via a first constriction.

34. A device according to claim 33, wherein a measuring chamber is connected to a bypass duct fitted with check valve means allowing pilot fluid to flow in said duct only in a second flow direction corresponding to the slide being displaced from its first position towards its second position.

35. A device according to claim 34, wherein the bypass duct is fitted with a second constriction.

* * * * *